US005736309A

United States Patent [19]

Kawamoto

[11] Patent Number: 5,736,309

[45] Date of Patent: Apr. 7, 1998

[54] PHOTOGRAPHIC SUPPORT AND A METHOD OF MANUFACTRING THE SAME

[75] Inventor: Fumio Kawamoto, Minami-ashigara, Japan

[73] Assignee: Fuji Photo Film Co., Ltd., Minami-ashigara, Japan

[21] Appl. No.: 891,078

[22] Filed: Jul. 10, 1997

Related U.S. Application Data

[63] Continuation of Ser. No. 520,393, Aug. 29, 1995, abandoned.

[30] Foreign Application Priority Data

Aug. 29, 1994 [JP] Japan ..... 6-203757

[51] Int. Cl.[6] ..... G03C 1/76

[52] U.S. Cl. ..... 430/533; 430/449; 430/935

[58] Field of Search ..... 430/449, 935, 430/533; 428/480; 427/171, 296, 391

[56] References Cited

U.S. PATENT DOCUMENTS 4,592,953 6/1986 Farrar et al. ..... 428/480

5,270,160 12/1993 Hiraoka et al. ..... 428/480

5,472,831 12/1995 Nishiura et al. ..... 428/480

FOREIGN PATENT DOCUMENTS 116378 4/1994 Japan .

*Primary Examiner*—Geraldine Letscher

*Attorney, Agent, or Firm*—Burns, Doane, Swecker & Mathis, LLP

[57] ABSTRACT

There is disclosed a method of manufacturing a photographic polyester film, comprising forming an unstretched film controlling; each of the temperature of the inlet of a melt extruder, at a temperature in the range from "the melting point of the polymer (Tm)"−10° C. to the Tm+15° C.; the temperature of the central part of a screw, at a temperature in the range from the Tm to the Tm+30° C.; and the temperature of the outlet thereof, at a temperature in the range from the Tm+10° C. to the Tm+35° C., followed by biaxial stretching and heat-setting, and a photographic support manufactured by the method. The thus obtained photographic polyester support excels in photographic properties, adhesiveness, and mechanical strength, and that moreover hardly causes a core set curl and fog formation.

5 Claims, No Drawings

PHOTOGRAPHIC SUPPORT AND A METHOD OF MANUFACTRING THE SAME

This application is a continuation of application Ser. No. 08/520,393, filed Aug. 29, 1995, now abandoned.

FIELD OF THE INVENTION

The present invention relates to a method of manufacturing a support for a silver halide photographic light-sensitive material that exhibits excellent photographic properties and satisfactory adhesiveness for a coated layer.

BACKGROUND OF THE INVENTION

Recently, with increasing variety of the use environment of silver halide photographic materials, high-speed film conveyance at photographing, high-magnification for shots, and small-sized photographing apparatuses, are making rapid progress. In these instances, there has been a demand for such properties as strength and dimensional stability, and for a film of thin make, as a support for the photographic light-sensitive material.

Further, to accompany the small-sized photographing apparatuses, the demand for a small-sized patrone is increasing.

In a conventional 135 system, the diameter of a roll is 14 mm, even for a 36-frame roll of photographic film, whose diameter is a minimum inside of the patrone. When the diameter of a roll is made 10 mm or smaller, a strong core set curl is caused. When this roll of photographic film is developed by a compact lab automatic processor, the film is wound up because only the top of the film is fixed with a leader, while the bottom of the film, which is the side of the roll core and which has a tough core sen curl, is not fixed at all. Supplying of a processing solution into a portion of the core set curl is delayed, which causes "unevenness of processing." Further, this wound-up-film is squeezed with rolls of the mini lab automatic processor, and then "breaks" are occurred.

In order to resolve this problem, there is proposed a method of eliminating the core set curl, wherein a polyester support is subjected to heat treatment at glass transition temperature (hereinafter abbreviated as Tg) or below. However, when a conventional silver halide light-sensitive layer, which has been coated on a TAC support, is coated on such a polyester support, dye density of the low-density coloring part is apt to increase for a color negative photographic material, whereas dye density of the high-density coloring part is apt to decrease for a color positive photographic material.

Methods of decreasing the amount of acetaldehyde in these polyester supports are disclosed in JP-A (JP-A means a published unexamined Japanese patent application) No. 116378/1994.

SUMMARY OF THE INVENTION

Accordingly, an object of the present invention is to provide a method of manufacturing a photographic polyester support that excels in photographic properties, adhesiveness, and mechanical strength, and that moreover hardly causes a core set curl and fog formation.

Other and further objects, features, and advantages of the invention will appear more fully from the following description.

DETAILED DESCRIPTION OF THE INVENTION

The object has been attained by a method of manufacturing a photographic polyester film, comprising forming an unstretched film controlling; each of the temperature of the inlet of a melt extruder, at a temperature in the range from "the melting point of the polymer (Tm)"−10° C. to the Tm+15° C.; the temperature of the central part of a screw, at a temperature in the range from the Tm to the Tm+30° C.; and the temperature of the outlet thereof, at a temperature in the range from the Tm+10° C. to the Tm+35° C., followed by biaxial stretching and heat-setting (this method is referred to as first invention).

Further, the above-mentioned object has been attained by a method of manufacturing a photographic biaxially stretched polyester film, comprising subjecting polyester pellets, whose ratio of surface area ($mm^2$) to volume ($mm^3$) is not less than 0.5, to heat treatment at a temperature in the range of from the Tg+10° C. to the Tm−20° C., and then to a melt extrusion (this method is referred to as second invention).

Further, the above-mentioned object has been attained by a polyester support, wherein the amount of an oligomer remaining after production of the polyester film support is 1.5 to 0 $mg/m^2$, more preferably 1.0 to 0 $mg/m^2$, and further more preferably 0.7 to 0 $mg/m^2$.

First invention and second invention of the present invention are described below in detail and the explanations in this specification refer to both the first and second inventions unless otherwise specified.

Manufacturing of a polyester film is usually performed by a method involving a melt extrusion, a stretch (orientation), and a heat-set, in this order. Of these steps, the melt extrusion is carried out at the highest temperature, and a large amount of acetaldehyde is easily generated in this process. Accordingly, the generation of acetaldehyde at the high-temperature part was decreased by improving a heat supply method at this step. Further, this improvement also prevented deterioration of the surface of polyester due to insufficient dissolution, which is easily caused when the extrusion temperature is lowered.

The extrusion is usually carried out by passing polymer pellets into a heated screw and melting them. On the other hand, in the present invention, the temperature at this step is not constant; rather the temperature of the screw is elevated at a specific pattern divided into several blocks from the inlet of the screw. In the present invention, preferably, the temperature of the inlet side of an extruder is lower than that of the outlet of the extruder. More preferably, the temperature of the central part of the screw of the extruder (middle temperature) is higher than that of the inlet, but lower than that of the outlet.

A preferable pattern of the temperature elevation (rise in temperature in extruder) is as follows:

| | |
|---|---|
| the temperature: of the inlet | a melting point temperature of the polymer (Tm) − 10° C. to Tm + 15° C., more preferably Tm to Tm + 10° C. |
| the temperature: of the central part of the screw | Tm to Tm + 30° C., more preferably Tm + 10° C. to Tm + 25° C. |
| the temperature: of the outlet | Tm + 10° C. to Tm + 35° C., more preferably Tm + 15° C. to Tm + 30° C. |

The amount of acetaldehyde that will be generated is drastically increased when the temperature of the screw exceeds the Tm+10° C. On the other hand, in order for the photographic support to have considerably high homogeneity, it is preferable to make a film after sufficiently melting a polymer. A temperature of Tm+10° C. or higher is necessary for this reason. Accordingly, a temperature of Tm+10° C. or higher is necessary to make a film, but the time period of heating is made as short as possible. For this purpose, at the inlet of the screw, which serves as the rate-determining step of the heat supply to the polymer, the temperature is decreased to as low as possible, so that the period of time for which the polymer is exposed to high temperature may become as short as possible.

Such an extrusion step is preferably carried out within a time period of from 3 minutes to 30 minutes, more preferably from 4 minutes to 20 minutes, and furthermore preferably from 5 minutes to 15 minutes. When the extrusion step is longer than the above-mentioned period of time, the amount of acetaldehyde that will be generated becomes much more, whereas when the step is shorter than that period of time, homogeneity of the thus made film is easily deteriorated; in other words, insufficiently molten polymer is easily generated.

According to this method of the present invention, the amount of acetaldehyde that will be generated can be decreased to a range of from 0.5 to 5 ppm, preferably 4 ppm or less, and more preferably 3 ppm or less.

Further, when oligomer exists at the surface of polyester, adhesiveness is considerably lowered.

These oligomers are mainly composed of dimer, trimer, tetramer, and/or pentamer, and some oligomers forms a ring. Further, most of the oligomers generated when a polyester is obtained by polymerization according to transesterification, have a hydroxyl group at the end of their polymeric molecule.

In order to decrease an amount of those remaining oligomers, it is effective to expel oligomers generated during polymerization out of pellets by heating before extrusion.

Since a rate of "de-oligomer-treatment" out of pellets of the polyester support according to the present invention is determined by diffusion of oligomers, it is a point to increase the surface area per unit of volume as much as possible. The ratio of surface area ($mm^2$) to volume ($mm^3$) is preferably 0.5 or greater, more preferably 0.8 or greater, and most preferably t or greater. Outside of this range is not preferred, because de-acetaldehyde-treatment takes a longer time.

Heat treatment of these pellets is performed preferably at a temperature from the Tg+10° C. to the Tm−20° C., more preferably from the Tg+30° C. to the Tm−35° C., furthermore preferably from the Tg+50° C. to the Tm−40° C., for a period of time from 30 minutes to 24 hours, more preferably from 1 hour to 12 hours, and furthermore preferably from 2 hours to 6 hours.

At a temperature lower than the above-described range, the diffusion speed is greatly lowered, so that a longer treatment time is needed. On the other hand, a temperature higher than the above-described range is not preferred, because the amount of acetaldehyde that will be generated is increased again by decomposition of the polyester, and also the good handling properties with the pellets are lowered by melt adhesion between them. Further, preferably such a treatment is carried out in vacuo or in a current of an inactive gas (e.g., nitrogen), whereby a lowering of molecular weight or a coloring due to hydrolysis and oxidization can be prevented.

By subjecting pellets to this heat treatment, it is preferred to reduce the amount of oligomer remaining in a film after the film making to a range of from 1.5 to 0 $mg/m^2$, more preferably from 1.0 to 0 $mg/m^2$, and furthermore preferably from 0.7 to 0 $mg/m^2$. By this treatment, a support having an excellent adhesiveness can be obtained.

Further, by subjecting the above-mentioned formed pellets to this heat treatment, there is also obtained an effect that acetaldehyde simultaneously generated during a polymerization can be efficiently expelled out of the pellets.

Preferred among monomers of a dicarboxylic acid unit constituting a polyester according to the present invention, are aromatic dicarboxylic acids, such as naphthalene dicarboxylic acids (e.g., 2,6-, 1,5-, 1,4-, and 2,7-), terephthalic acid (TPA), isophthalic acid (IPA), orthophthalic acid (OPA), and paraphenylenedicarboxylic acid (PPDC), with 2,6-naphthalenedicarboxylic acid (2,6-NDCA) being more preferable. Preferably the content of naphthalenedicarboxylic acid contained in all dicarboxylic acid residual groups is not less than 30 mol %, more preferably 50 mol % or more, and furthermore preferably 70 mol % or more.

Preferable diols are ethylene glycol (EG), cyclohexanedimethanol (CHDM), neopentylglycol (NPG), bisphenol A (BPA), and biphenol (BP), with ethylene glycol being more preferred. Further, parahydroxybenzoic acid (PHBA) and 6-hydroxy-2-naphthalene carboxylic acid (HNCA) may be used as a hydroxycarboxylic acid. This naphthalenedicaboxylic acid residual group and this ethylene glycol residual group may each exist in the form of copolymer or in the form of polymer blend.

Polyesters are produced by polymerizing these monomers. Preferred examples of the polyesters include homopolymers, such as polyethylene naphthalate and polycyclohexanedimethanol telephthalate (PCT); and copolymers, such as a copolymer of telephthalic acid, 2,6-naphthalenedicarboxylic acid, and ethylene glycol (a molar ratio of telephthalic acid and 2,6-naphthalenedicarboxylic acid to be mixed is preferably in the range of from 0.5:0.5 to 0:1.0, and more preferably from 0.7:0.4 to 0:1.0); a copolymer of 2,6-naphthalenedicarboxylic acid, ethylene glycol, and bisphenol A (a molar ratio of ethylene glycol and bisphenol A to be mixed is preferably in the range of from 0.5:0.5 to 1.0:0, more preferably from 0.6:0.5 to 1.0:0); a copolymer of isophthalic acid, paraphenylenedicarboxylic acid, 2,6-naphthalenedicarboxylic acid, and ethylene glycol (a molar ratio of isophthalic acid or paraphenylenedicarboxylic acid to naphthalenedicarboxylic acid is preferably in the range of from 0.1 to 0.5, and more preferably each from 0.2 to 0.3); a copolymer of 2,6-naphthalenedicarboxylic acid, neopentylglycol, and ethylene glycol (a molar ratio of neopentylglycol and ethylene glycol is preferably in the range of from 0.5:0.5 to 0.3:0.7); a copolymer of 2,6-naphthalenedicarboxylic acid, ethylene glycol, and biphenol (a molar ratio of ethylene glycol and biphenol is preferably in the range of from 0.5:0.5 to 1.0:0, more preferably from 0.7:0.3 to 1.0:0); and a copolymer of parahydroxybenzoic acid, ethylene glycol, and 2,6-naphthalenedicarboxylic acid (a molar ratio of parahydroxybenzoic acid and ethylene glycol is preferably in the range of from 0.5:0.5 to 0.1:0.9, more preferably from 0.3:0.7 to 1.0:0).

Of these polyesters, the most excellent polymer in the standpoints of mechanical strength and core set curl-eliminating properties is polyethylene naphthalate, particularly polyethylene-2,6-naphthalate (PEN). These polyethylene naphthalate films may be a copolymer or a polymer blend, unless photographic characteristics thereof are deteriorated.

These copolymers and homopolymers can be synthesized by previously known methods of producing polyesters. For example, polyesters can be synthesized by subjecting an acidic component and a glycol component directly to esterification (direct-polymerization process), or, when a dialkylester, such as dimethylesters and diethylesters being preferable, is used as an acidic component, by subjecting the dialkylester and a glycol component to transesterification, and then removing an excess glycol component while heating under reduced pressure (transesterification process). Polyesters can also be prepared by reacting an acid halide, as an acidic component, with glycol. Among these, preference is given to the transesterification process.

During these reactions, if necessary, optional use can be made of transesterification catalysis or polymerization reaction catalysis, or a heat stabilizer, such as phosphorous acid, phosphoric acid, trimethyl phosphate, triethyl phosphate and tetraethyl ammonium compounds, may be added.

Further, to these, there can be added a ultraviolet absorbent, for providing storage stability. The ultraviolet absorbent preferably has no absorption in the visible range, and its addition amount is generally from about 0.5 weight % to about 20 weight %, and preferably from about 1 weight % to about 10 weight %, based on the weight of the polymer film. The ultraviolet absorbent cannot sufficiently prevent deterioration due to ultraviolet rays if the amount is too small. Example ultraviolet absorbents, that may be used are benzophenones, such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone and 2,2'-dihydroxy-4,4'-dimethoxybenzophenone; benzotriazoles, such as 2(2'-hydroxy-5-methylphenyl) benzotriazole, 2(2'-hydroxy-3',5'-di-t-butylphenyl) benzotriazole and 2(2'-hydroxy-3'-di-t-butyl-5'-methylphenyl)benzotriazole; and salicylic acids, such as phenyl salicylate and methyl salicylate.

A refractive index of aromatic-series polyesters is as high as 1.6 to 1.7. On the other hand, a refractive index of gelatin, which is a main component of a photosensitive layer coated on the polyester, is from 1.50 to 1.55, which is lower than the above value of 1.6 to 1.7. Therefore, a ray of light incident upon a film edge reflects at the interface between a base and an emulsion layer, and causes so-called light-piping phenomenon (edge-fogging).

Several methods for preventing such light-piping phenomenon are known. For example, inert inorganic grains or dyes are added to the film for the above-described purpose. Of these methods, the addition of dyes is preferred, since this method little increases film haze.

With respect to dyes for use in film dyeing, a color tone is preferably gray-dyeing in terms of general properties of the photosensitive material. Preferably the dye excels in heat resistance at the temperature zone for film production of the polyester, and it also excels in miscibility to the polyester.

The expected results for the dye can be achieved by mixing commercially marketed dyes for polyesters, such as Diaresin (trade name), manufactured by Mitsubishi Kasei Corp., and Kayaset (trade name), manufactured by Nippon Kayaku Corp., from the above point of view.

The polyester film that is used in the present invention can be given smoothness according to its use, and a general method such as kneading of inert inorganic materials together with the polyester, or coating of surfactants on the polyester, are used for this purpose.

Examples of such inert inorganic grains are $SiO_2$, $TiO_2$, $BaSO_4$, $CaCO_3$, talc, and kaolin. Further, a method of giving smoothness to the polyester, which comprises depositing catalyst or something like that, which is added at the time of polymerization reaction of the polyester, i.e., a method in which an internal grain system is used, can be used as well as the above described method in which inert external grains are added to a reactor for preparing the polyester. As to the external grain system, it is preferred to chose $SiO_2$, which has a refractive index relatively close that of the polyester film. Alternatively, it is also preferable to chose an internal grain system in which the size of grains to be deposited can be made relatively small.

Furthermore, in order to improve transparency of the film, it is also preferable to laminate such layers provided a function. Means for this can be concretely mentioned a co-extrusion process by plural extruders and feed blocks, or a multi-manifold die.

These syntheses and preparations of polyesters can be performed with reference to, for example, descriptions in "Condensation polymerization and Addition polymerization," High Molecular Experimental Study No. 5, pp 103–136, published by Kyoritsu Shuppan (1980), and "Synthetic High Molecule V." pp 187–286, published by Asakura Shoten (1971), or JP-A Nos. 163337/1993, 179052/1991, 3420/1990, 275628/1989, 290722/1987 and 241316/1986.

Among the thus polymerized polmers, the polymer whose intrinsic viscosity measured an 35° C. in a solvent orthochlorophenol is 0.40 or more, but 0.9 or less, more preferably from 0.45 to 0.70 is preferable.

Among these polyesters, the polyester whose glass transition temperature (Tg) is 90° C. or higher, but 200° C. or lower, more preferably 95° C. or higher, but 190° C. or lower, and further preferably 100° C. or higher, but 180° C. or lower is preferable.

Preferable specific examples of polyester that can be used in the present invention are mentioned below, which, however, are not intended to restrict the scope of the present invention.

Examples of Polyester Homopolymers

*P*-1: Polyethylene Naphthalate (*PEN*) [2,6-Naphthalene dicarboxylic acid (*NDCA*)/Ethylene glycol (*EG*) (100/100)] (*PEN*) Tg=119° C. Tm=268° C.

Examples of Polyester Copolymers (the figures in parenthesis indicate a molar ratio)

| | | | |
|---|---|---|---|
| P-2: | 2,6-NDCA/TPA/EG (90/10/100) | Tg = 109° C. | Tm = 264° C. |
| P-3: | 2,6-NDCA/TPA/EG (75/25/100) | Tg = 102° C. | Tm = 260° C. |
| P-4: | 2,6-NDCA/TPA/EG/BPA (50/50/75/25) | Tg = 112° C. | Tm = 242° C. |
| P-5: | 2,6-NDCA/EG/BPA (100/50/50) | Tg = 155° C. | Tm = 236° C. |
| P-6: | 2,6-NDCA/EG/BPA (100/90/10) | Tg = 125° C. | Tm = 253° C. |
| P-7: | 2,6-NDCA/EG/CHDM/BPA (100/50/25/25) | Tg = 130° C. | Tm = 238° C. |
| P-8: | 2,6-NDCA/EG/PEG (average molecular weight 100) (100/80/20) | Tg = 105° C. | Tm = 232° C. |
| P-9: | 2,6-NDCA/NPG/EG (100/50/50) | Tg = 135° C. | Tm = 251° C. |
| P-10: | 2,6-NDCA/EG/BP (100/80/20) | Tg = 125° C. | Tm = 249° C. |
| P-11: | PHBA/EG/2,6-NDCA (200/100/100) | Tg = 150° C. | Tm = 243° C. |

Examples of a Blend of Polyester-polymers (the figures in parenthesis indicate a weight ratio)

| | | | |
|---|---|---|---|
| P-12: | PEN/PET (60/40 | Tg = 95° C. | Tm = 256° C. |
| P-13: | PEN/PET (80/20) | Tg = 104° C. | Tm = 258° C. |
| P-14: | PAr/PEN (10/90) | Tg = 127° C. | Tm = 255° C. |
| P-15: | PAr/PCT/PEN (10/10/80) | Tg = 135° C. | Tm = 254° C. |

-continued

| | | |
|---|---|---|
| P-16: PAr/PC/PEN (10/10/80) | Tg = 140° C. | Tm = 249° C. |
| P-17: PEN/PET/PAr (50/25/25) | Tg = 108° C. | Tm = 245° C. |

The thus polymerized PEN or modified PEN is processed to make pellets having the above-described size, and then it is subjected to heat treatment according to the above-mentioned method, which results in deacetaldehyde treatment and de-oligomer treatment.

The thus obtained pellets are molten in an extruder according to the above-described method, and then processed to make a stretched film according to a conventional method.

Preferably the extruded molten polymer is previously passed through a filter. Examples of the filter include a wire net, a sintered wire net, a sintered metal, sand, and a glass fiber.

After filtration, the molten polymer is casted onto a cooling drum. Adhesion between the molten polymer and the drum becomes an important factor for determining the surface flatness of a polymer. For this reason, it is preferred to set an electrode having impressed high voltage between a T-die mouthpiece and the cooling drum, and to generate a charge on an unsolidified polymer, whereby adhesion between the polymer and the cooling drum is improved (hereinafter referred to as "static adhesion"). Further, preferably the intrinsic viscosity of the thus obtained unstretched film is from 0.45 to 0.9.

A blend containing two or more polymers can be made using a conventional multiaxial kneading extruder. Further, a laminate film may be made by any one of a co-extruding method, an in-line-laminate method, and an off-line-laminate method. According to the co-extruding method of the above-described methods, a film can be made using a feedblock or a multi-manifold. The former has manifolds in accordance with the number of layers, which are linked up with each other at a die line part, whereas the latter is designed to have a linking system in a layer at a pipe part of the die for a single layer. According to the in-line laminate method, a biaxially stretched laminate film is obtained by laminating unstretched or monoaxially stretched film, and then subjecting the laminate film to further stretching (orientation). According to the off-line laminate method, biaxially stretched films are laminated by heat or various adhesives, to make a biaxially stretched laminate film.

The thus obtained unstretched film is subjected to simultaneously or successively biaxial stretching, heat-setting, and heat moderation, to make a stretched film. The number of stretchings in the longitudinal direction and the transverse direction is not limited. A stretched film can be manufactured by subjecting the unstretched film to stretching (orientation) in a monoaxial direction (a longitudinal direction or a transverse direction) at a temperature from (Tg–10)°C. to (Tg+70)°C. by a magnification of from 2.5- to 4.0-fold, and then subjecting the monoaxially stretched film to further stretching in a perpendicular direction to the above-described stretching direction (i.e., when the first stretching is made in the longitudinal direction, the second stretching is made in the transverse direction) at a temperature of from the Tg°C. to (Tg+70)°C. by a magnification of from 2.5- to 4.0-fold. A preferred magnification is from 2.7- to 3.8-fold, more preferably from 2.8- to 3.5-fold, for the longitudinal stretching; and from 2.5- to 4.0-fold, more preferably from 2.7- to 3.8-fold, and furthermore preferably from 2.8- to 3.5-fold, for the transverse stretching. When the magnification of the longitudinal and the transverse stretching is small, the flatness of the base becomes bad and mechanical strength is also insufficient. On the other hand, when the magnification of the stretching is large, the face orientation properties become large and cleavage is apt to generate, which results in generation of waste at the time of processing (perforation).

Further, it is preferred to heat-set the thus obtained biaxially oriented film at a temperature of from (Tg+70)°C. To the Tm°C. For example, a polyethylene-2,6-naphthalate film is preferably heat-set at a temperature of from 190° to 250° C., and the period of time for the heat-set thereof is preferably from 1 second to 60 seconds, and more preferably from 5 seconds to 30 seconds.

Further, according to the method disclosed in U.S. Pat. No. 5,076,977, a curl in a reverse direction may be imparted by providing a temperature differential between a surface and a back surface of the film in the stretching process. The thus prepared film becomes easy to curl with its side having been given a lower temperature inward. Therefore, when a light-sensitive layer is coated on the other side opposite to the above-described side, it is possible to reduce a curl in the width direction, which curl occurs due to shrinkage of the light-sensitive layer under a low humidity.

The above-described biaxially stretched films are also made by the methods disclosed in JP-A Nos. 109715/1975 and 95374/1975.

The thickness of the support is preferably from 60 to 100 μm, more preferably from 70 to 100 μm, and furthermore preferably from 80 to 95 μm. When the support is thinner than the above-described lower limit, its mechanical strength is insufficient and a gutter-like curl occurs due to shrinkage of the emulsion layer under a dry state. As a result, an "out of focus" and the generation of friction are easily caused.

The content of acetaldehyde contained in the thus prepared support is preferably from 0 ppm to 5 ppm, more preferably from 0 ppm to 4 ppm, and furthermore preferably from 0 ppm to 3 ppm.

Heat treatment of the support according to the present invention is described below. It is possible to eliminate the core set curl from the support by heat treatment at a temperature of from 50° C. to the Tg, as described in U.S. Pat. No. 4,141,735.

The heat treatment is conducted preferably at 50° C. or higher but lower than the Tg, more preferably at the Tg–35° C. or higher but lower than the Tg, and furthermore preferably at the Tg–20° C. or higher but lower than the Tg. When the heat treatment is conducted at lower than 50° C., it takes a long time to cause an adequate effect on eliminating the core set curl, which results in poor productivity. On the other hand, when the heat treatment is conducted at a temperature of the Tg or higher, elimination of the core set curl is not sufficiently attained.

The heat treatment may be carried out at a constant temperature, or alternatively heating or cooling within the above-mentioned range. The period of time for the heat treatment is preferably from 0.1 hours to 1500 hours, more preferably from 0.5 hours to 500 hours, and furthermore preferably from 1 hour to 300 hours. When the period of time is too short, it is difficult to obtain a sufficient effect. On the other hand, when the period of time is too long, the above-mentioned effect is saturated and a support may easily be colored or developed brittleness.

The above-described heat treatment of the support may be carried out while conveying the support in a roll form or in a web form. When the heat treatment is conducted in the roll form, use may be made of a method wherein the roll is subjected to the heat treatment at a room temperature and in a thermostat (hereinafter referred to as a low-temperature rolling method), or a method wherein the support is heated at a definite temperature while conveying in the web form, and then wound in the roll form, followed by heat treatment (hereinafter referred to as a high-temperature rolling method). Of these methods, the latter is more preferable because core set curl is better eliminated and equipment investment cost can be saved.

The heat treatment may be carried out at any step, i.e., after the film-making, but before a coating of the light-sensitive layer has been finished. Of these steps, it is preferred to carry out the heat treatment before coating a subbing layer of a light-sensitive layer, but after a surface treatment of the support.

However, the heat treatment that is aimed to eliminate the core set curl is generally carried out for a long time, even at a relatively low temperature, and therefore acetaldehyde is easily generated. Moreover, since the heat treatment is carried out in the roll form for industrial-scale performance, the generated acetaldehyde is difficult to be expelled. For this reason, a polyester support having a low acetaldehyde content has been needed. The acetaldehyde content of the support according to the present invention is low, so that the acetaldehyde content can be controlled to a sufficiently low level even after this heat treatment. Therefore this heat treatment is an effective method.

In order to strongly adhere a photographic layer (e.g., a light-sensitive silver halide emulsion layer, an interlayer, a filter layer, an electrically conductive layer) onto a support composed of a polyester derivative according to a method of the present invention, effective methods are one in which a support is subjected to a surface-activating treatment, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment, and then a photographic layer is directly coated on the support; or a method in which a support is subjected to the above-described surface-activating treatment, and then a subbing layer is coated on the support, followed by a coating of a photographic layer thereon.

The corona discharge treatment is the most well-known method, and the discharge frequency is generally from 50 Hz to 5,000 Hz, and preferably from 5 KHz to several hundred KHz. A discharge frequency below the above-described range is not preferred, because a stable discharge is not attained and pinholes are formed in the finished support. On the other hand, a discharge frequency above the above-described range also is not preferred, since such a frequency necessitates a special apparatus for impedance matching, which results in high cost. The treatment strength of the support is generally from 0.001 KV.A.min/m$^2$ to 5 KV.A.min/m$^2$, and preferably from 0.01 KV.A.min/m$^2$ to 1 KV.A.min/m$^2$, for the purpose of improving the wetness of ordinary polyester derivatives. The gap clearance between the electrode and the dielectric material roll is generally from 0.5 to 2.5 mm, preferably from 1.0 to 2.0 mm.

When a solid state corona discharging processor, the 6 KVA Model manufactured by Philla Company, is used, the discharge frequency during the treatment is preferably from 5 to 40 KHz, and more preferably from 10 to 30 KHz. A preferable wave form thereof is an AC sinusoidal wave. The gap clearance between the electrode and the dielectric material roll is preferably from 1 to 2 mm, and more preferably from 1.4 to 1.6 mm. The treatment amount is preferably from 0.3 to 0.4 KV.A.min/m$^2$, and more preferably from 0.34 to 0.38 KV.A.min/m$^2$.

With respect to ultraviolet ray treatment, when a high-pressure mercury lamp emitting 365-nm rays as a main wavelength is used, the amount of rays to be applied is preferably in the range of from 20 to 10,000 (mJ/cm$^2$), and more preferably from 50 to 2,000 (mJ/cm$^2$). On the other hand, when a low-pressure mercury lamp emitting 254-nm rays as a main wavelength is used, the amount of rays to be applied is preferably in the range of from 100 to 10,000 (mJ/cm$^2$), and more preferably from 200 to 1,500 (mJ/cm$^2$).

With respect to glow discharge treatment, when steam is introduced into an atmosphere, particularly the most excellent adhesion effect is attained. Furthermore, this treatment is also very effective for eliminating a yellow stain of support and preventing the support from blocking.

When glow discharge treatment is conducted in the presence of water vapor, its vapor pressure is preferably in the range of from 10% to 100%, and more preferably from 40% to 90%. When the vapor pressure is below the above-mentioned range, it is difficult to obtain a satisfactory adhesion. An example of gas to be used other than stream is air containing oxygen and nitrogen.

Quantitative introduction of steam into the atmosphere of the glow discharge is attained by a method wherein a gas is led to a 4-polar-type mass spectrograph (MSQ-150, manufactured by Nippon Shinku Co.) from a sampling tube attached to a glow discharge processor; and then the composition of the gas is successively measured.

Further, when a pro-heated support to be surface-treated is subjected to a vacuum glow discharge treatment, the adhesion is improved in a shorter time, and moreover yellow staining of the support can be considerably eliminated, compared to when the support is treated at room temperature. The term "pre-heat" herein referred to is different from the hereinafter described heat treatment for improving a core set curl.

The temperature of the pre-heat is preferably from 50° C. to the Tg, more preferably from 70° C. to the Tg, and furthermore preferably from 90° C. to the Tg. When a support is pro-heated above the Tg, adhesion is deteriorated.

Specific examples of methods for elevating the surface temperature of the support in a vacuum, are methods of heating the support by an infrared heater, or by contacting it on a heated roll. Various other heating methods that are known publicly can also be used.

The glow discharge treatment is preferably conducted by conveying a support between multiple electrodes, each of which is parallel to the width direction of the support film, with each electrode having a hollow part, which works as a flowing pass for a refrigerant.

The degree of vacuum at the glow discharge treatment is preferably 0.005 to 20 Torr, and more preferably from 0.02 to 2 Torr. When the pressure is much lower than the above-described range, it is difficult to satisfactorily modify the surface of the support, and to obtain adequate adhesion properties. On the other hand, when the pressure is much higher than the above-described range, a stable discharge is difficult.

Further, the voltage to be applied is preferably in the range between 500 and 5,000 V, and more preferably between 500 and 3,000 V. When the voltage is much lower than the above-described range, it is difficult to satisfactorily modify the surface of the support, so that satisfactory adhesion cannot be obtained. On the other hand, when the voltage is much higher than the above-described range, the quality of the surface thereof is deteriorated, and undesirably the adhesion is lowered.

Further, the discharge frequency to be used is from DC current to several thousands MHz, as is conventionally employed, preferably from 50 Hz to 20 MHz, and more preferably from 1 KHz to 1 MHz.

The desired adhesion is obtained when the discharge treatment strength is preferably from 0.01 KV.A.min/$m^2$ to 5 KV.A.min/$m^2$, and more preferably from 0.15 KV.A.min/$m^2$ to 1 KV.A.min/$m^2$.

Preferably the support thus subjected to glow discharge treatment is instantly cooled with a cooling roll. The support easily undergoes plastic deformation by stress, as the temperature to be applied thereto increases. As a result, the flatness of the support to be treated is deteriorated. Furthermore, low-molecular substances (e.g., monomers and oligomers) deposit on the surface of the support, which may result in deterioration of transparency and blocking.

Flame treatment may be conducted using a natural gas or a liquid propane gas, but the ratio of these gases to the air to be mixed is important. With respect to propane gas, a preferred mixed ratio in volume of the propane gas to the air is from 1/14 to 1/22, and more preferably from 1/16 to 1/19. Further, a preferred mixed ratio of the natural gas to the air is from 1/6 to 1/10, and more preferably from 1/7 to 1/9. The flame treatment is preferably conducted in the range of from 1 to 50 Kcal/$m^2$, and more preferably from 3 to 30 Kcal/$m^2$. It is more effective to keep the distance between the top of the inner flame of the burner and the support less than 4 cm. A flame treatment apparatus manufactured by Kasuga Denki Co., Ltd. can be used. Preferably the backup roll holding a support at the flame treatment is a hollow-type roll through which a cooling water is passed in order to cool the roll with water, whereby the flame treatment is always conducted at a constant temperature.

It is preferable to apply an antistatic layer onto a support of the present invention. The antistatic agent to be used for this purpose is not limited, with electrically conductive antistatic agents or compounds that have an electrification-row regulating function being exemplified.

Examples of the electrically conductive antistatic agents include metal oxides and ionic compounds. The electrically conductive antistatic agents that are preferably used in the present invention are electrically conductive metal oxides and their derivatives, electrically conductive metals, carbon fibers, and π-conjugated system high molecular compounds (e.g., polyarylene vinylene), each of which does not lose its antistatic ability even after the developing process, with crystalline metal oxide particles being particularly preferred.

Most preferably electrically conductive metal oxide particles are fine particles of crystalline metal oxide of at least one selected from among ZnO, $TiO_2$, $SnO_2$, $Al_2O_3$, $In_2O_3$, $SiO_2$, MgO, BaO, $MoO_3$, and $V_3O_5$, or these complex oxides. Among these, the particularly preferable compounds are electrically conductive materials whose main component is $SnO_2$, while about 5 to 20% of antimony oxide and/or further other component (e.g., silicon oxide, boron, and phosphorus) may be contained. The volume resistivity of the fine particles of electrically conductive crystalline oxides or their complex oxides is preferably not more than $10^7$ Ωcm, more preferably not more than $10^6$ Ωcm, and furthermore preferably not more than $10^5$ Ωcm. When the volume resitivity is higher than the above-described range, a sufficient antistatic property cannot be obtained. Further, preferably their particle size is in the range of from 0.002 to 0.7 μm, and particularly preferably from 0.005 to 0.3 μm. Fine particles of these crystalline metal oxides or these complex metal oxides are described in JP-A Nos. 143430/1976 and 258541/1985 in detail. These electrically conductive metal oxides may be coated with a coating solution that is free of a binder. Preferably the coating amount is not more than 1 g/$m^2$, more preferably from 0.001 to 0.5 g/$m^2$, furthermore preferably from 0.005 to 0.3 g/$m^2$, and particularly preferably from 0.01 to 0.3 g/$m^2$. In this case, it is preferable further to coat a binder onto the coating layer.

Further, more preferably the electrically conductive metal oxides used in the present invention are coated with a binder. The preferable coating amount of the metal oxides in this case is not more than 1 g/$m^2$, more preferably from 0.001 to 0.5 g/$m^2$, furthermore preferably from 0.005 to 0.5 g/$m^2$, and particularly preferably from 0.01 to 0.3 g/$m^2$. Preferably the coating amount of the binder is from 0.001 to 2 g/$m^2$, more preferably from 0.005 to 1 g/$m^2$, and furthermore preferably from 0.01 to 0.5 g/$m^2$. At this time, the weight ratio of the metal oxide to the binder is preferably from 1000/1 to 1/1000, more preferably from 500/1 to 1/500, and furthermore preferably 250/1 to 1/250. These metal oxides may be mixture of a spherical oxide and a fibriform oxide.

A subbing layer, which is located between a surface-treated support and a light-sensitive layer, is described below.

As a coating of the subbing layer, there are two types of coating, i.e., a so-called multilayer coating, wherein, as the first layer, a layer that well adheres to a support (hereinafter referred to as the first subbing layer) is coated on the support, and then, as the second layer, a layer that well adheres to both the first subbing layer and a photographic layer is coated on the first subbing layer (hereinafter referred to as the second subbing layer); and a single layer coating, wherein only a layer that well adheres to both a support and a photographic layer is coated on the support.

For the first subbing layer in the multilayer coating, use is made of, such as copolymers copolymerized using, as a starting material, monomers selected from among vinyl chloride, vinylidene chloride, butadiene, vinyl acetate, styrene, acrylonitrile, methacrylate ester, methacrylic acid, acrylic acid, itaconic acid, maleic acid anhydride, and the like; epoxy resins; gelatin; nitrocellulose; poly(vinyl acetate). These materials are described in detail, for example, by E. H. Immergut, in *Polymer Handbook*, a 187–231, Interscience Pub., New York, 1966. For the second subbing layer, gelatin is mainly used.

For the single layer coating, a method that is often used to obtain an excellent adhesion, comprises swelling a support to cause interfacial mixing with a subbing polymer. Examples of the subbing polymers include water-soluble polymers, such as gelatin, gelatin derivatives, casein, agar-agar, sodium alginate, starch, polyvinyl alcohol, copolymers derived from polyacrylic acid, and copolymers derived from maleic acid anhydride; cellulose esters, such as carboxymethylcellulose and hydroxyethylcellulose; and latex polymers, such as copolymers derived from vinyl chloride, copolymers derived from vinylidene chloride, copolymers derived from an acrylic acid ester, and copolymers derived from vinyl acetate. Gelatin is most preferable of these polymers. As the gelatin, use may be made of any kind of gelatin generally used in this technical field, such as a so-called lime-treated gelatin, an acid-treated gelatin, an enzyme-treated gelatin, gelatin derivatives, and a modified gelatin, with a lime-treated gelatin and an acid-treated gelatin being most preferable. These gelatins may contain various impurities in their production process, such as 0.01 to 20,000 ppm of metals (e.g., metals, such as Na, K, Li, Rb, Ca, Mg, Ba, Ce, Fe, Sn, Pb, Al, Si, Ti, Au, Ag, Zn, and Ni, and their ions), and other ions (e.g., $F^-$, $Cl^-$, $Br^-$, $I^-$, sulfate ion, nitrate ion, acetate ion, ammonium ion). In particular, it is general knowledge that lime-treated gelatins contain calcium ions and magnesium ions. Their contents very widely range, from 10 to 3,000 ppm, but, in the standpoint of subcoating properties, the content is preferably not more than 1,000 ppm, and more preferably not more than 500 ppm.

The subbing layer that is used in the present invention may optionally contain various additives, such as a surfactant, an antistain agent, an antihalation agent, a dye, a pigment, a coating aid, and an antifoggant.

Further, the subbing layer may contain, as a matting agent, inorganic or organic fine particles in an amount that does not substantially harm the transparency and granularity of the image. Examples of the inorganic fine-grained matting agents to be used include silica ($SiO_2$), titanium dioxide ($TiO_2$), calcium carbonate, and magnesium carbonate. Examples of the organic fine-grained matting agents to be used include polymethylmethacrylate, celluloseacetatepropionate, polystyrene, a processing solution-soluble material, as described in U.S. Pat. No. 4,142,894, and polymers, as described in U.S. Pat. No. 4,396,706. The average grain size of these fine-grained matting agents is preferably from 0.01 to 10 μm, and more preferably from 0.05 to 5 μm. The content of the matting agent is preferably from 0.5 to 600 mg/m$^2$, and more preferably from 1 to 400 mg/m$^2$.

As a compound that swells a support that is used in the present invention, use can be made of resorcin, chlororesorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid, chloral hydrate, and the like, with resorcin and p-chlorophenol being most preferred.

A sub-coating solution that is used in the present invention can be coated on a support by any one of generally well-known methods, such as a dip coating, an air-knife coating, a curtain coating, a roller coating, a wirebar coating, a gravure coating, and an extrusion coating using a hopper, as described in the specification of U.S. Pat. No. 2,681,294. Furthermore, according to circumstances, multilayers can be simultaneously coated by a method as described, for example, in the specifications of U.S. Pat. Nos. 2,761,791, 3,508,947, 2,941,898, and 3,526,528, and in Yuji Harasaki, *Coating Technology* (Coating Kogaku) p. 253 (edited by Asakura Shoten, 1973).

It is preferred to coat such the subbing layer after the heat treatment acording to the present invention. This is because, since these subbing layers are to impart adhesiveness, many subbing layers are sticky. As a result, the degree of distortion is apt to increase, which results in deterioration of the flatness after the heat treatment.

Next, descriptions will be made with reference to photographic layers of photographic light-sensitive material according to the present invention.

As silver halide emulsion layers, each of the emulsion layers light-sensitive for color and for black/white can be mentioned. Explanations will be made hereinbelow with reference to color silver halide photographic light-sensitive materials.

It is sufficient that the photographic material of the present invention has on a support at least one silver halide emulsion layer of a blue-sensitive layer, a green-sensitive layer, or a red-sensitive layer, and there is no particular restriction on the number of silver halide emulsion layers and non-light-sensitive layers or on the order of these layers. A typical example is a silver halide photographic light-sensitive material having on a support at least one light-sensitive layer comprising multiple silver halide emulsion layers that have substantially the same color sensitivity but are different in light sensitivity, wherein said light-sensitive layer is a unit light-sensitive layer having color sensitivity to any one of blue light, green light, and red light. In the case of a multilayer silver halide color photographic light-sensitive material, generally the arrangement of unit light-sensitive layers is such that a red-sensitive layer, a green-sensitive layer, and a blue-sensitive layer are placed in the stated order from the support side. However, the order of the arrangement may be reversed in accordance with the purpose, and between layers having the same color sensitivity there may be placed a different light-sensitive layer.

A non-light-sensitive layer, such as various intermediate layers, may be placed between or on top of or beneath the above-mentioned silver halide light-sensitive layers.

The silver halide emulsion may be used generally that has been physically ripened, chemically ripened, and spectrally sensitized. When an emulsion sensitized by a gold compound and sulfur-containing compound is used, the efficiency of the present invention can be particularly remarkably found. Additives that will be used in these steps are described in *Research Disclosure* No. 17643, and ibid. No. 18716, and involved sections are listed in the Table shown below.

Known photographic additives that can be used in the present invention are also described in the above-mentioned two Research Disclosures, and involved sections are listed in the same Table below.

| Kind of Additive | RD 17643 | RD 18716 |
|---|---|---|
| 1 Chemical sensitizer | p. 23 | p. 648 (right column) |
| 2 Sensitivity-enhancing agent | — | p. 648 (right column) |
| 3 Spectral sensitizers and Supersensitizers | pp. 23–24 | pp. 648 (right column)–649 (right column) |
| 4 Brightening agents | p. 24 | |
| 5 Antifogging agents and Stabilizers | pp. 24–25 | p. 649 (right column)– |
| 6 Light absorbents, Filter dyes and Ultraviolet absorbents | pp. 25–26 | p. 649 (right column)–650 (left column) |
| 7 Stain-preventing agent | p. 25 (right column) | p. 650 (left to right column) |
| 8 Color image stabilizers | p. 25 | |
| 9 Film hardeners | p. 26 | p. 651 (left column) |
| 10 Binders | p. 26 | p. 651 (left column) |
| 11 Plasticizers and Lubricants | p. 27 | p. 650 (right column) |
| 12 Coating aids and Surface-active agents | pp. 26–27 | p. 650 (right column) |

The color photographic light-sensitive material according to the present invention can be subjected to the development processing by an ordinary method as described in the above-mentioned *Research Disclosure* No. 17463, pp. 28–29, ibid. No. 18716, p. 615, from left column to right column.

In the silver halide color photographic material of the present invention, a color developing agent can be incorporated for the purpose of simplifying and shortening of processing. To incorporate the agent, preferably various precursors of color developing agent are used. As such compounds, can be mentioned, as described in *Research Disclosure* No. 13924, an indaniline series compound, as described in U.S. Pat. No. 3,342,597, and a Shiff base series compound, as described in U.S. Pat. No. 3,342,599, *Research Disclosure* Nos. 14,850 and 15,159.

It is preferable to roll the thus prepared photographic light-sensitive material onto a spur having an external diameter of 3 to 10 mm. When the external diameter is too short, trouble is caused at a developing process and a good handling property is deteriorated. Therefore the spur should not be smaller than the above-mentioned size. On the other hand, when the external diameter is too large, it is difficult to make a small-sized cartridge.

A polyester support in which a content of the remaining acetaldehyde after film-production is 5 ppm or less, and which exhibits excellent photographic characteristics, can be obtained by the present invention, i.e., a method of manufacturing a photographic polyester film, which method comprises controlling each of the temperature of the inlet of the melt extruder, in the range from a melting point of a polymer (Tm)−10° C. to the Tm+15° C.; the temperature of the central part of the screw, in the range from the Tm°C. to the Tm+30° C.; and the temperature of the outlet thereof, in the range from the Tm+10° C. to the Tm+35° C., to form an unstretched film, followed by a biaxial stretching and a heat-setting.

Further, a polyester support, with a content of remaining oligomer after film-production being from 1.5 to 0 mg/m$^2$, which exhibits an excellent adhesion, can be obtained by the present invention, i.e., a method of manufacturing a photographic biaxially stretched polyester film, which method comprises subjecting polyester pellets, whose ratio of surface area (mm$^2$) to volume (mm$^3$) is not less than 0.5, to heat treatment at a temperature of from the Tg+10° C. to the Tm−20° C., and then to a melt extrusion.

A measurement that is used in the present invention is described below.

1. Content of acetaldehyde in a support (1) Sample

A support in the shape of film, which had not been subjected to a surface treatment, a coating, and the like, was cut off in the size of 40 mm×50 mm.

(2) Extraction of acetaldehyde

The above-described sample was contained in a purge & trap apparatus (for example, JHJ-1000-type curie point head space sampler, manufactured by Nippon Sunseki Kogyo Co., Ltd.) and heated for 30 seconds at 150° C. while purging with 50 ml/min of helium gas, and then volatile components were trapped at −80° C.

(3) Measurement

The components thus trapped by the above method were rapidly heated (385° C./10 seconds) and led to GC/MS (for example, GC: HP-5890 A-type gas chromatography, manufactured by Hewlett Packard Company, MS: HP-5970 B-type mass spectrometer, manufactured by Hewlett Packard Company).

GC Condition

Temperature of injection head: 250° C.

Column temperature: the temperature was kept at 40° C. for 4 minutes, and then elevated to 200° C. (10° C./min)

Column: J & W DB-WAX 0.25 mm×30 m (a thickness of the membrane: 0.25 μm)

Injection method: split method (a split ratio: 1/200)

Carrier gas: helium

Condition for detecting acetaldehyde

A mass chromatograph was measured marking m/z=43 originated from acetaldehyde.

The identification of the peak was performed with a standard solution for the calibration curve, as described below.

Calibration curve

Eighty (80) wt % of an acetaldehyde solution was diluted with isopropanol, to make 1 mg/ml of a standard solution. Then, the standard solution was further diluted with isopropanol, to prepare a sample having one-tenth of the concentration of the standard solution. These two standard solutions were injected to GC/MS, and the calibration curve was made marking m/z=43 in the same manner as described above.

2. Glass transition temperature (Tg) and Melting temperature (Tm)

The Tg and the Tm referred to in this specification could be measured by means of a differential scanning calorimeter (DSC). For example, a sample weighing 10 mg was heated in nitrogen stream up to 300° C. at a rate of temperature rise of 20° C./min, and then it was rapidly cooled to room temperature, to make the sample amorphous. After that, the sample was again heated at a rate of temperature rise of 20° C./min, to prepare a DTA curve. The arithmetic mean of the temperature at which the curve began to deviate from the baseline, and the temperature at which the curve returned to the baseline, was taken as the Tg. The temperature at which the curve again returned to the baseline after an endothermic amount at the melting peak reached the maximum by further heating the sample, was taken as the Tm.

3. Amount of remaining oligomers

A film was dipped in chloroform and allowed to stand for 60 minutes at 25° C. After that, the film was removed and chloroform was evaporated, and then an amount of the residue was weighed. From the above amount of the residue, was subtracted, as a blank, the amount of residue obtained when the same amount of solution containing only chloroform was volatilized. The value of the net weight (mg) divided by the area (m$^2$) of the sample was defined as the amount of remaining-oligomers.

The present invention is described below with specific, but not limiting, examples.

At first, the evaluation and the measurement that are used in these examples are explained below.

1. Evaluation of Photographic Properties

A light-sensitive material having coated on it light-sensitive layers was cut into strips, each of size 35 mm (width)×12 cm (length), and these strips were subjected to a wedge exposure to white light (4800K), and then a couple of strips were stored at 5° C., 30% RH for 7 days. Another couple of strips were stored at 55° C., 30% RH for 7 days. After that, a color negative photographic material was subjected to a color negative developing process, as described below. With respect to these strips, measurement of densitometry of B, G, and R was conducted, to obtain a characteristic curve.

Measured from the characteristic curve were a minimum density, and a logarithmic value of the reciprocal of an exposure amount necessary to give a density of the minimum density plus 0.2.

The absolute value of the difference between the value obtained from a sample stored at 55° C., 30% RH and the value obtained from a sample stored at 5° C., 30% RH (hereinafter referred to as a ΔDmin and a ΔSnega, respectively) was calculated, and these values were evaluated.

2. Evaluation of Core Set Curl and Evaluation of Processing Aptitude with a Processor for Compact Labs (Color Negative Light-Sensitive Material)

The ease of formation of a core set curl, the ease of eliminating the core set curl at development processing, and the processing aptitude with a processor for compact labs (passability through compact labs), were evaluated according to the following procedure:

(2-1) Core Set

Sample film: Width 35 mm, Length 1.2 m

Regulation of humidity: 25° C., 60% RH overnight

Core set: The sample film was rolled onto a spur having a diameter of 7 mm, with the film's side having coated on it a light-sensitive layer being inward, and the resulting rolled film was set in a sealed container. After that, the film was heated at one of the conditions described below (these are shown in a Table).

80° C., 2 hours; a condition simulating film that is left in a car in the summer season (it is preferred that no trouble happens in this condition)

50° C., 24 hours; which corresponds to the degree of the curl obtained within the available period of a photographic emulsion, i.e., from 2 to 3 years at room temperature. (It is essential that no trouble happens at this condition.)

Cooling to room temperature: a film is allowed to stand in a room at 25° C. overnight.

(2-2) Measurement of Core Set Curl and Evaluation of Passability through Compact Labs Evaluation of Core Set Curl before Development The sample thus cooled to room temperature was taken out of the sealed container, to release the core set. Immediately after that, the curl at the most internal lap of the film was measured according to a test method A of ANSI/ASC PH1.29-1985, and was indicated by the 1/R [m] (R stands for the radius of the curl).

3. Evaluation of Passability through Compact Labs

A film having a strong core set curl is apt to cause a problem during a developing process with a compact lab in most cases. For this reason, the following evaluation was conducted.

Immediately after the measurement of the core set curl before development, color development was conducted using a compact lab processor (Compact Lab FP-550B, CN-16Q developing solution, trade-names, manufactured by Fuji Photo Film Co., Ltd.). A compact lab processing was carried out by fixing an end of the film with its side having been curled outward, to a leader according to a conventional method.

The sample films having been subjected to the compact lab processing were evaluated by visual observation, marking the following standpoints:

cracks: a strongly curled sample cannot pass through a nip roll for a drive in the compact lab, and is struck, so that cracks occur at the end of the sample opposite to the leader. The number of cracks generated in a piece of this sample was counted. A sample in which even one crack is generated lacks marketability.

Unevenness: a strongly curled sample passes through in a compact lab in a rolled form. Therefore a sufficient amount of a developing solution cannot be supplied to the inside of the curled sample, which results in an "unevenness" of the development. The samples were evaluated by visual observation, and when even a slight unevenness was observed with the naked eye, its evaluation was taken as "NG," whereas when no unevenness was observed, its evaluation was taken as "OK."

Evaluation of Core Set Curl after Development

Immediately after development processing with a compact lab processor, a curl at the side of the most internal lap was measured according to the above-described method.

4. Content of Acetaldehyde

A measurement was conducted according to the above-described method.

5. An Amount of Remaining Oligomers

A measurement was conducted according to the above-described method.

6. Tg, Tm

A measurement was conducted according to the above-described method.

7. Evaluation of Adhesion (7-1) Evaluation of Adhesion in the Dry State

Adhesive tapes were stuck on both surfaces of a photographic emulsion layer and a backing layer, and then they were torn off in the direction (angle) of 180 degrees, to evaluate the level of adhesiveness. Samples that showed no separation were indicated as "○"; samples whose separated area was no more than 10% were indicated as "Δ"; and samples whose separated area was above 10% were indicated as "X". Samples indicated as "Δ" or "○" do not cause any serious problem in practical use.

(7-2) Evaluation of Adhesion in the Wet State

In each of the processing steps of color developing, bleaching, fixing, washing, and stabilization bath, both surfaces of a photographic emulsion layer and a backing layer, each surface having coated on a film support, were rubbed in a solution, to evaluate the level of adhesiveness. These tested samples were indicated as "○", "Δ", or "X", in the same standard as in the dry state.

8. Curl in the Width Direction (Transverse Curl)

A light-sensitive material cut off in the size of 35 mm (width)×2 mm (length) was subjected to a regulation of moisture under 10% RH at 25° C. overnight. This sample was measured according to Test Method A of ANSI/ASC pH1.29-1985, and the test result was indicated by "1/R [m]" (R stands for the radius of the curl).

9. Evaluation of Scratches Generated in a Camera

A light-sensitive photographic material prepared in Example was cut, perforated, and packed in a cartridge according to a 135 format, and then a Fuji ZOOM CARDIA 800, trade name, manufactured by Fuji Photo Film Ltd., was loaded with the cartridge and subjected to a regulation of moisture under 10% RH at 25° C., followed by photographing. After that, the amount of scratches generated on the back surface of the film was measured by visual observation. The amounts of scratches generated in a color negative light-sensitive material and in a color reversal light-sensitive material were compared to those materials each having a TAC base, each of which is a type. Those materials wherein a generation of scratches is equal to or less than, or somewhat more than, or more than, the scratches of the type material, were indicated as "○", "Δ", or "X", respectively.

10. Homogeneity of the Base (Surface Property)

The homogeneity of the film base, measured immediately after the production thereof, was evaluated by the number of dissolution residues of polymer pellets remaining in the base. That is, an area of 10 square centimeters was observed by an optical microscope, and the evaluation was conducted by counting insoluble materials of size 30 μm or larger. The bases were indicated as "○", "Δ", or "X", with the numbers of such insoluble materials being not more than 2, 4 to 5, and not less than 6, respectively. The symbols of "Δ" and "○" mean an acceptable base.

EXAMPLE 1

(1) Preparation of Support (a) Preparation of PEN Support (P-1)(Level 1-1 to 14)

Polyethylene-2,6-naphthalate was polymerized in the same manner as of the support (A) of Example 1 as described in *Kokaigiho*, article No. 94-6023, published by Hatsumei Kyokai. Its intrinsic viscosity was 0.50. Its Tg was 119° C. and its Tm was 268° C. To a solid component of this polyester, were added 54 ppm of each of the following dye compound I-6 and compound 1-24, described in Japanese Patent Application No. 316676/1993, and 0.1% of spherical silica particles, of average particle size 0.3 μm.

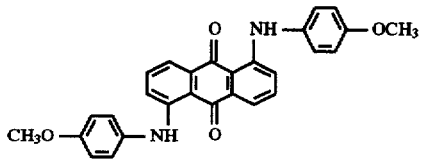

(I-6)

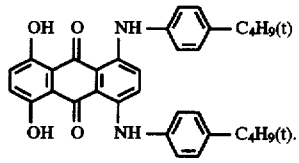

(I-24)

The thus obtained product was processed to make pellets having the size shown in Table 2, and then each of these pellets was subjected to a heat treatment in a nitrogen stream with stirring under the condition shown in Table 2. The thus heat-treated material was extruded by means of an ordinary monoaxial extruder under the condition shown in Table 2, and it was passed through a sintered metal filter of 5 μm. After that, the material was also extruded from a T-type die maintained at the same temperature as that of the outlet of the extruder, onto a casting drum maintained at Tg−20° C., according to an electrostatic impression method. The thickness of the film at this time was controlled so that the thickness of the film having been subjected to a stretching and a heat-set became that shown in Table 2.

The thus prepared film was stretched 3.2 times in the longitudinal direction at Tg+10° C., and 3.3 times in the width direction at Tg+25° C., and then it was subjected to heat-setting at 250° C. for 10 seconds, while conducting 3% of relaxation.

(b) Preparation of Copolymer or Polymer Blend Support (Levels 1-15 to 18)

Level 1-15 (P-2)

A polyester copolymer comprising as a component, 2,6-naphthalene dicarboxylic acid dimethyl ester: terephthalic acid dimethyl ester:ethylene glycol (molar ratio; 90:10:100), was polymerized by an transesterification according to a conventional method. To this copolymer were added the same dyes and spherical silica particles in the same amounts as those incorporated in the PEN support. Its intrinsic viscosity was 0.60. Its Tg was 109° C. and its Tm was 264° C. This copolymer was processed to make pellets; it was subjected to a heat treatment, and then it was extruded by means of the monoaxial extruder under the condition shown in Table 2, in the same manner as the PEN support. After that, this material was subjected to a casting, a longitudinal stretching, a transverse stretching, and then a heat-setting, in the same manner as the PEN support, to obtain a biaxially stretched film.

Level 1-16 (P-6)

A polyester copolymer comprising as a component, 2,6-naphthalene dicarboxylic acid dimethyl ester:bisphenol A:ethylene glycol (molar ratio; 100:10:90), was polymerized by an transesterification according to a conventional method. To this copolymer were also added the same dyes and spherical silica particles in the same amounts as those incorporated in the PEN support. Its intrinsic viscosity was 0.61. Its Tg was 125° C. and its Tm was 253° C. This copolymer was processed to make pellets; it was subjected to a heat treatment, and then it was extruded by means of a monoaxial extruder under the condition indicated in Table 2, in the same manner as the PEN support. After that, this material was subjected to a casting, a longitudinal stretching, a transverse stretching, and then a heat-setting, in the same manner as the PEN support, to obtain a biaxially stretched film.

Level 1-17 (P-13)

The PEN was polymerized by the above-described method. The PET was polymerized by a conventional direct polymerization. To these polymers were also added the same dyes and spherical silica particles in the same amounts as those incorporated in the above-described PEN support. These PEN and PET were mixed in the proportion of 80:20 (weight ratio), and the resulting mixture was extruded by means of a biaxial kneading extruder, and then processed to make pellets having the size shown in Table 2. Its Tg was 104° C. and its Tm was 258° C. At the time of extrusion, the temperature was varied regarding three parts of the screw in a biaxial kneading extruder; that is, the temperature was respectively set at 280° C. (inlet side), 290° C. (middle temperature), and 300° C. (outlet side). These pellets were heat-treated under the condition shown in Table 2, extruded, and then subjected to a casting, a longitudinal stretching, a transverse stretching, and a heat-setting, in the same manner as the PEN support, to obtain a biaxially stretched film.

Level 1-18 (P-14)

A polyarylate (PAr) comprising as a component of polymer, bisphenol A and terephthalic acid, was polymerized according to a conventional method. Its intrinsic viscosity was 0.55. The PEN was polymerized by the above-described method. To these polymers were also added the same dyes and spherical silica particles in the same amounts as those incorporated in the above-described PEN support. These PAr and PEN were mixed in the proportion of 10:90 (weight ratio), and the resulting mixture was extruded by means of a biaxial kneading extruder, and then processed to make pellets having the size shown in Table 2. Its Tg was 127° C. and its Tm was 255° C. At the time of extrusion, the temperature was varied regarding three parts of the screw in a biaxial kneading extruder; that is, the temperature was respectively set at 290° C. (inlet side), 300° C. (middle temperature), and 310° C. (outlet side). These pellets were heat-treated under the condition as shown in Table 2, extruded, and then subjected to a casting, a longitudinal stretching, a transverse stretching, and a heat-setting, in the same manner as the PEN support, to obtain a biaxially stretched film.

(2) Evaluation of Support

Amounts of each of acetaldehyde and oligomer remaining in the support film as manufactured by the above-described method and as shown in Table 2, as well as the surface condition (homogeneity of the base), were evaluated according to the above-described method.

(3) Surface Treatment of Support

The glow surface treatment, illustrated below, was carried out to the support, as shown in Table 2.

Four cylindrical rod electrodes, each of section diameter 2 cm and length 120 cm, were aligned at 10-cm intervals, and were fixed on an insulated plate. This electrode plate was placed in a vacuum tank. The support was conveyed parallel to and at a distance of 15 cm from the front of the electrode, so that the support was subjected to a surface treatment for 2 seconds. A heating roll of 50 cm diameter and equipped with a thermoregulator was set, so that a film contacted a ¾ lap of the roll immediately before the film passed through the electrode. Furthermore, the surface temperature of each of the films was controlled to its Tg−5° C., by contacting the surface of the film with a thermocouple thermometer in the region between the heating roll and the electrode zone.

The pressure in the vacuum container was regulated to 0.2 Torr, while the partial pressure of $H_2O$ in the gas medium was regulated to 75%. The discharge frequency was 30 KHz, and the processing strength of each of the levels was 5 kW. A vacuum glow discharge electrode was used according to the method as described in Japanese patent application No. 147864/1993. The support, having been subjected to the discharge treatment, was wound while in contact with a cooling roll of 50 cm diameter and equipped with a thermoregulator, so that the surface temperature of the support would be lowered to 30° C. before its winding.

(4) Coating of First Backing Layer (Electrically Conductive Layer)

The term "part" hereinafter referred to means a part by weight.

In 3,000 parts of ethanol, were dissolved 230 parts of stannic chloride hydrate and 23 parts of antimony trichloride, to prepare a uniform solution. To the solution was added, dropwise, a 1N sodium hydroxide aqueous solution, to adjust to a pH of 3, thereby to co-precipitate colloidal stannic oxide and antimony oxide. The thus obtained co-precipitate was allowed to stand at 50° C. for 24 hours, to obtain a reddish brown colloidal precipitate, which was collected by centrifugation.

The solid was washed three times with water by centrifugation, to remove excess ions.

In 1500 parts of water, was re-dispersed 200 parts of the colloidal precipitate that had had excess ions removed from it, and the dispersion was atomized into a calcining furnace heated at 500° C., to obtain blue-tinted fine particles of stannic oxide-antimony oxide complex having an average particle size of 0.005 μm and resistivity of 25 Ω.cm.

A mixture of 40 parts of the resulting fine particles and 60 parts of water was adjusted to pH 7.0, coarsely dispersed in a stirrer, and finely dispersed in a horizontal sand mill (Dynomill, manufactured by Willy A. Backfen AG) for a retention time of 30 minutes, to prepare a dispersion in which primary particles were partly condensed to form a secondary condensation having a particle size of 0.05 μm.

A coating solution having the formulation shown below was coated on the support other than TAC, as shown in Table 2, to a dry thickness of 0.3 μm, and the support was dried at 110° C. for 30 seconds.

Formulation

| | |
|---|---|
| Dispersion of electrically conductive fine particles above prepared ($SnO_2/Sb_2O_2$, 0.15 μm) | 100 parts |
| Gelatin | 10 parts |
| Water | 270 parts |
| Methanol | 600 parts |
| Resorcin | 20 parts |
| Nonionic surfactant (Nonionic surfactant I-13 as described in "JP-B" (JP-B means examined and published Japanese Patent Publication) No. 27099/1991) | 0.1 part |

(5) Heat Treatment of Support (BTA Tratment)

A support was wrapped around an aluminum hollow core of 300 mm diameter. This material was set in a thermostat and subjected to a heat treatment under the condition shown in Table 2. The wrapping of the support around the core was always carried out with its side to be coated with a backing layer (the side opposite to a casting drum at the production of a film) facing inward.

(6) Coating of Subbing Layer (Side to be Coated with a Photographic Emulsion Layer)

A solution for the subbing layer having the following formulation was coated on the support shown in Table 2, at a spread of 10 ml/m$^2$ by means of a wire bar. After drying at a temperature of Tg−5° C. for 2 minutes, the film was wound.

Formulation

| | |
|---|---|
| Gelatin | 10.0 parts |
| Water | 24.0 parts |
| Methanol | 961.0 parts |
| Salicylic acid | 3.0 parts |
| Polyamide-epichlorohydrine resin as described in Synthetic Example 1 of JP-A 3619/1976 | 0.5 parts |
| Nonionic surfactant (Nonionic surfactant I-13 as described in JP-B No. 27099/1991) | 0.1 part |

(7) Coating of Second Backing Layer

To the surface-treated support, shown in Table 2, having coated thereon the subbing layer and the first backing layer (electrically conductive layer), was further coated a solution having the following formulation, to a dry thickness of 1.2 μm, and the support was dried at a temperature of Tg−5° C.

Formulation

| | |
|---|---|
| Diacetylcellulose | 100 parts |
| Trimethylolpropane-3-toluenediisocyanate | 25 parts |
| Methylethylketone | 1050 parts |
| Cyclohexane | 1050 parts |

(8) Coating of Third Backing Layer (Lubricant Layer)

(8-1) Preparation of First Solution for Lubricant Layer

The first solution, having the following formulation and dissolved by heating at 90° C., was added to the second solution, and the mixture was dispersed by means of a high-pressure homogenizer, to obtain a lubricant undiluted dispersion.

First Solution

| | |
|---|---|
| Lubricant (T3-4) | 0.7 g |
| Lubricant (T1-2) | 1.1 g |
| Xylene | 2.5 g |

(8-2) Preparation of Second Solution for Lubricant Layer

To the first solution for the lubricant layer, was added the following binders and solvents, to prepare a coating solution.

| | |
|---|---|
| Propyleneglycol monomethyl ether | 34.0 g |
| Diacetylcellulose | 3.0 g |
| Acetone | 600.0 g |
| Cyclohexane | 350.0 g |

(8-3) Coating of Lubricant Layer

With respect to all the levels shown in Table 2, the above-described coating solution was coated on the outermost backing layer, by means of a wire bar coater, in a coating amount of 10 ml/m$^2$, and the layer was dried at the Tg−5° C. for 10 minutes.

(9) Preparation of Color Negative Light-Sensitive Material

Layers having the following compositions were multi-coated on the thus prepared support, as shown in Table 2, to prepare a multi-layer color negative light-sensitive material.

Support of Level 1-1 to 1-18 was coated color negative light-sensitive layers shown below.

(Composition of light-sensitive layer)

Coating amounts for silver halide and colloidal silver are represented by g/m$^2$ in terms of silver; coating amounts for coupler, additive, and gelatin are represented by g/m$^2$, and coating amounts for sensitizing dye are shown in mol per mol of silver halide of the same layer. Symbols representing additives have the meanings shown below, provided that for additives having plural functions one function is described as a representative of the functions.

UV; Ultraviolet-rays absorber

Solv; High-boiling organic solvent

ExF; Dye

ExS; Sensitizing dye

ExC; Cyan coupler

ExM; Magenta coupler

ExY; Yellow coupler

Cpd; Additive

First Layer (Halation-preventing Layer)

| | |
|---|---|
| Black colloidal silver | silver 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-4 | $1.0 \times 10^{-3}$ |
| Solv-1 | 0.16 |
| Solv-2 | 0.10 |

Second Layer (Low Sensitivity Red-sensitive Emulsion Layer)

Silver iodobromide

| | |
|---|---|
| emulsion A | Silver coating amount 0.35 |

Silver iodobromide

| | |
|---|---|
| emulsion B | Silver coating amount 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-10 | $8.0 \times 10^{-2}$ |
| ExC-6 | $2.0 \times 10^{-2}$ |
| ExC-9 | $2.5 \times 10^{-2}$ |
| Cpd-3 | $2.2 \times 10^{-2}$ |

Third Layer (Medium Sensitivity Red-sensitive Emulsion Layer)

Silver iodobromide

| | |
|---|---|
| emulsion C | Silver coating amount 0.55 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.12 |
| ExC-6 | $2.0 \times 10^{-2}$ |

-continued

| | |
|---|---|
| ExC-7 | $2.5 \times 10^{-2}$ |
| ExC-9 | $3.0 \times 10^{-2}$ |
| ExC-10 | $7.0 \times 10^{-2}$ |
| Cpd-3 | $1.5 \times 10^{-3}$ |

Fourth Layer (High Sensitivity Red-sensitive Emulsion Layer)

Silver iodobromide

| | |
|---|---|
| emulsion D | Silver coating amount 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-3 | $1.0 \times 10^{-3}$ |
| Solv-1 | 0.70 |
| Solv-2 | 0.15 |

Fifthe Layer (Intermediate Layer)

| | |
|---|---|
| Gelatin | 0.62 |
| Cpd-1 | 0.13 |
| Poly(ethyl acrylate) latex | $8.0 \times 10^{-2}$ |
| Solv-1 | $8.0 \times 10^{-2}$ |

Sixth Layer (Low Sensitivity Green-sensitive Emulsion Layer)

Silver iodobromide

| | |
|---|---|
| emulsion B | Silver coating amount 0.10 |

Silver iodobromide

| | |
|---|---|
| emulsion A | Silver coating amount 0.28 |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | $8.0 \times 10^{-2}$ |
| ExM-7 | $2.1 \times 10^{-2}$ |
| ExM-8 | $5.1 \times 10^{-2}$ |
| Solv-1 | 0.09 |
| Solv-3 | $4.5 \times 10^{-3}$ |
| Solv-4 | $4.0 \times 10^{-2}$ |

Seventh Layer (Medium Sensitivity Green-sensitive Emulsion Layer)

Silver iodobromide

| | |
|---|---|
| emulsion A | Silver coating amount 0.28 |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.20 |
| ExM-7 | $7.2 \times 10^{-2}$ |
| ExM-9 | $6.5 \times 10^{-2}$ |
| ExY-1 | $5.4 \times 10^{-2}$ |
| Solv-1 | 0.23 |

-continued

| | |
|---|---|
| Solv-3 | $1.8 \times 10^{-2}$ |

Eighth Layer (High Sensitivity Green-sensitive Emulsion Layer)
Silver iodobromide

| | | |
|---|---|---|
| emulsion H | Silver coating amount | 0.53 |
| Gelatin | | 0.61 |
| ExS-4 | | $4.3 \times 10^{-4}$ |
| ExS-5 | | $8.6 \times 10^{-5}$ |
| ExS-8 | | $2.8 \times 10^{-5}$ |
| ExM-2 | | $5.5 \times 10^{-3}$ |
| ExM-3 | | $1.0 \times 10^{-2}$ |
| ExM-5 | | $1.0 \times 10^{-2}$ |
| ExM-6 | | $3.0 \times 10^{-2}$ |
| ExY-1 | | $1.0 \times 10^{-2}$ |
| ExC-1 | | $4.0 \times 10^{-3}$ |
| ExC-4 | | $2.5 \times 10^{-3}$ |
| Cpd-5 | | $1.0 \times 10^{-2}$ |
| Solv-1 | | 0.12 |

Ninth Layer (intermediate Layer)

| | |
|---|---|
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Poly(ethyl acrylate) latex | $5.0 \times 10^{-2}$ |
| Solv-1 | $3.0 \times 10^{-2}$ |
| Solv-4 | $2.0 \times 10^{-2}$ |

Tenth Layer (Donner Layer of interlayer Effect for Red-sensitive Layers)
Silver iodobromide

| | | |
|---|---|---|
| emulsion I | Silver coating amount | 0.40 |

Silver iodobromide

| | | |
|---|---|---|
| emulsion J | Silver coating amount | 0.20 |

Silver iodobromide

| | | |
|---|---|---|
| emulsion K | Silver coating amount | 0.39 |
| Gelatin | | 0.87 |
| ExS-3 | | $6.7 \times 10^{-4}$ |
| ExM-2 | | 0.16 |
| ExM-4 | | $3.0 \times 10^{-2}$ |
| ExM-5 | | $5.0 \times 10^{-2}$ |
| ExY-2 | | $2.5 \times 10^{-3}$ |
| ExY-4 | | $2.0 \times 10^{-2}$ |
| Solv-1 | | 0.30 |
| Solv-5 | | $3.0 \times 10^{-2}$ |

Eleventh Layer (Yellow Filter Layer)

| | |
|---|---|
| Yellow colloidal silver | $9.0 \times 10^{-2}$ |
| Gelatin | 0.84 |
| Cpd-1 | $5.0 \times 10^{-2}$ |
| Cpd-2 | $5.0 \times 10^{-2}$ |
| Cpd-4 | $2.0 \times 10^{-3}$ |
| Solv-1 | 0.13 |
| H-1 | 0.25 |

Twelfth Layer (Low Sensitivity Blue-sensitive Emulsion Layer)
Silver iodobromide

| | | |
|---|---|---|
| emulsion L | Silver coating amount | 0.50 |

Silver iodobromide

| | | |
|---|---|---|
| emulsion M | Silver coating amount | 0.40 |
| Gelatin | | 1.75 |
| ExS-6 | | $9.0 \times 10^{-4}$ |
| ExY-1 | | $8.5 \times 10^{-2}$ |
| ExY-2 | | $5.5 \times 10^{-3}$ |
| Y-(1) | | 0.27 |
| ExY-4 | | 0.80 |
| ExC-1 | | $5.0 \times 10^{-2}$ |
| ExC-2 | | $8.0 \times 10^{-2}$ |
| Solv-1 | | 0.54 |

Thirteenth Layer (Intermediate Layer)

| | |
|---|---|
| Gelatin | 0.30 |
| ExY-3 | 0.14 |
| Solv-1 | 0.14 |

Fourteenth Layer (High Sensitivity Blue-sensitive Emulsion Layer)
Silver iodobromide

| | | |
|---|---|---|
| emulsion N | Silver coating amount | 0.40 |
| Gelatin | | 0.95 |
| ExS-6 | | $2.6 \times 10^{-4}$ |
| ExY-2 | | $1.0 \times 10^{-2}$ |
| Y-(1) | | 0.10 |
| ExY-4 | | 0.10 |
| ExC-1 | | $1.0 \times 10^{-2}$ |
| Solv-1 | | $9.0 \times 10^{-2}$ |

Fifteenth Layer (First Protective Layer)
Fine-grain silver iodobromide

| | | |
|---|---|---|
| emulsion O | Silver coating amount | 0.12 |
| Gelatin | | 0.70 |
| UV-4 | | 0.11 |
| UV-5 | | 0.18 |
| Solv-4 | | $2.0 \times 10^{-2}$ |
| Poly(ethyl acrylate) latex | | $9.0 \times 10^{-2}$ |

Sixteenth Layer (Second Protective Layer)
Fine-grain silver iodobromide

| | | |
|---|---|---|
| emulsion O | Silver coating amount | 0.36 |
| Gelatin | | 0.85 |
| B-1 (diameter 2.0 μm) | | $8.0 \times 10^{-2}$ |
| B-2 (diameter 2.0 μm) | | $8.0 \times 10^{-2}$ |
| B-3 | | $2.0 \times 10^{-2}$ |
| W-5 | | $2.0 \times 10^{-2}$ |
| H-1 | | 0.18 |

In addition to the above, the thus prepared Sample was added 1,2-benzisothiazoline-3-one (average 200 ppm to gelatin), n-butyl-p-hydroxybenzoate (average about 1,000 ppm to gelatin), and 2-phenoxyethanol (average about 10,000 ppm to gelatin). Further, in order to improve stability, processing property, pressure resistance, keeping property from mold and fungi, antistatic property, and coating property, besides above-mentioned components, W-1 to W-6, B-4 to B-6, F-1 to F-16 and iron salt, lead salt, gold salt, platinum salt, iridium salt, rhodium salt were optionally contained in all emulsion layers.

TABLE 1

| Emulsion | Average AgI content (mol %) | Average grain diameter* (μm) | Deviation coefficien of grain diameter distribution (%) | Ratio of diameter/thickness | Ratio of silver amount [core/intermediate/shell] or [core/shell] (AgI content) | | Grain structure and shape |
|---|---|---|---|---|---|---|---|
| A | 4.7 | 0.40 | 10 | 1.0 | [4/1/5] | (1/38/1) | Triple structure cubic grains |
| B | 6.0 | 0.49 | 23 | 2.0 | [2/1] | (16/1) | Double structure tabular grains |
| C | 8.4 | 0.65 | 23 | 2.2 | [3/5/2] | (0/14/7) | Triple structure tabular grains |
| D | 8.8 | 0.65 | 15 | 3.5 | [12/59/29] | (0/12/6) | Triple structure tabular grains |
| E | 4.0 | 0.35 | 25 | 2.8 | — | — | Uniform structure tabular grains |
| F | 4.0 | 0.50 | 18 | 4.0 | — | — | Uniform structure tabular grains |
| G | 3.5 | 0.55 | 15 | 3.5 | [12/59/29] | (0/5/2) | Triple structure tabular grains |
| H | 10.0 | 0.70 | 20 | 5.5 | [12/59/29] | (0/13/8) | Triple structure tabular grains |
| I | 3.8 | 0.70 | 15 | 3.5 | [12/59/29] | (0/5/3) | Triple structure tabular grains |
| J | 8.0 | 0.65 | 28 | 2.5 | [1/2] | (18/3) | Double structure tabular grains |
| K | 10.3 | 0.40 | 15 | 1.0 | [1/3] | (29/4) | Double structure octahedral grains |
| L | 9.0 | 0.66 | 19 | 5.8 | [8/59/33] | (0/11/8) | Triple structure tabular grains |
| M | 2.5 | 0.46 | 30 | 7.0 | — | — | Uniform structure tabular grains |
| N | 13.9 | 1.30 | 25 | 1.0 | [7/13] | (34/3) | Double structure tabular grains |
| O | 2.0 | 0.07 | 15 | 1.0 | — | — | Uniform structure fine grains |

Note: *Average diameter of the sphere corresponding to the grain.

In Table 1

(1) Emulsions A to N were subjected to reduction sensitization using thiourea dioxide and thiosulfonic acid in accordance with Examples given in JP-A No. 191938/1990 when the grains were prepared.

(2) Emulsions A to N were subjected no gold sensitization, sulfur sensitization and selenium sensitization under the presence of sodium thiocianate and spectral sensitizing dyes described for each light-sensitive layers in accordance with Examples given in JP-A No. 237450/1991.

(3) In the preparation of tabular grains, low-molecular weight gelatins were used in accordance with Examples given in JP-A No. 158426/1989.

(4) Dislocation lines as described in JP-A No. 237450/1991 were observed in the tabular grains and the regular crystalline grains having grain structure under a high-voltage electron microscope.

(5) Emulsions A to N contained iridium inside of grain by the method described, for example, in B. H. Carroll, Photographic Science and Engineering, 24, 265 (1990).

Compounds added to the layers are shown below.

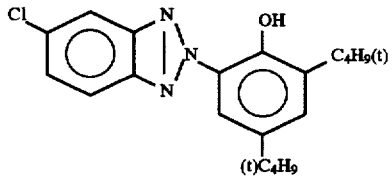

UV-1

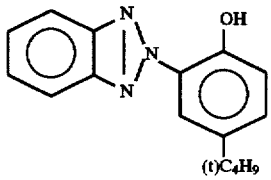

UV-2

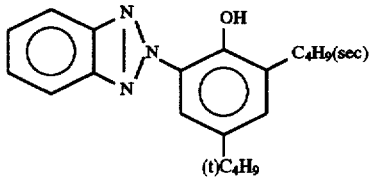

UV-3

-continued
UV-4
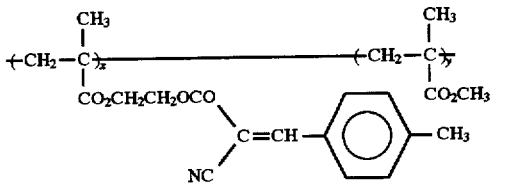
x:y = 70:30 (wt %)
UV-5
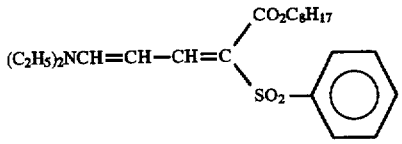
ExF-1
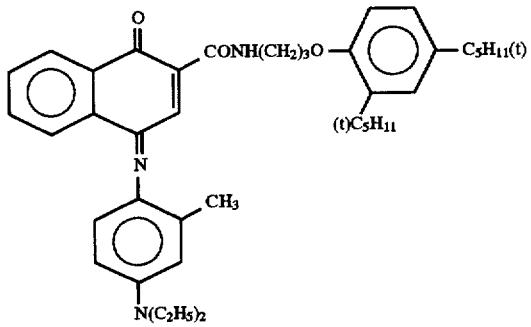
ExF-2
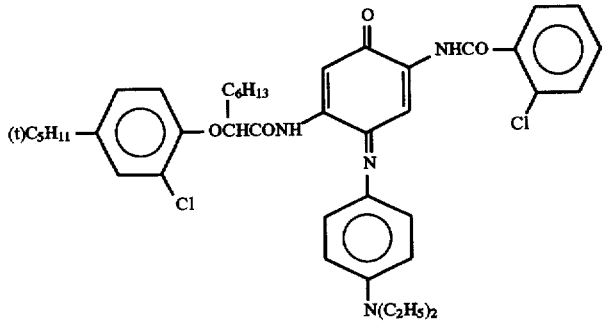
ExF-3
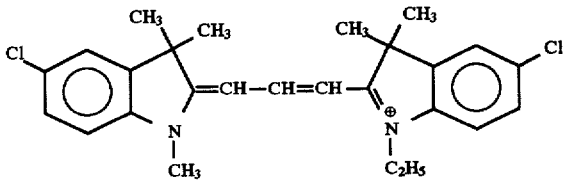
ExC-1
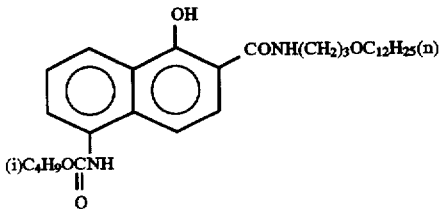

-continued
ExC-2
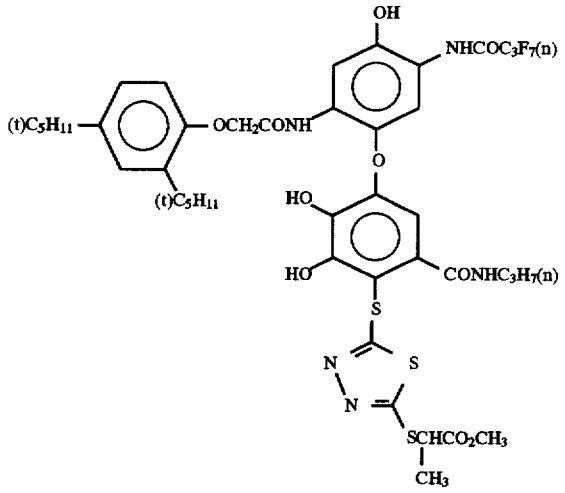
ExC-3
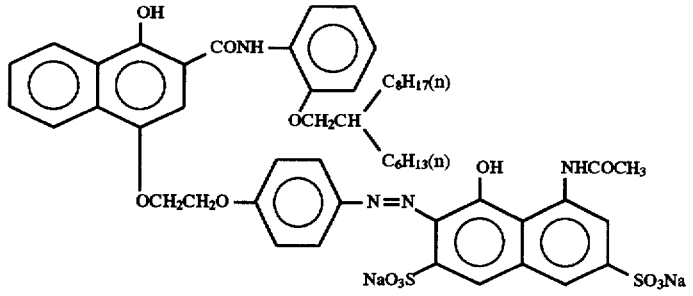
ExC-4
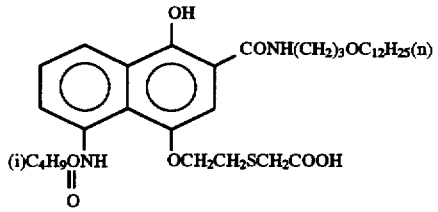
ExC-5
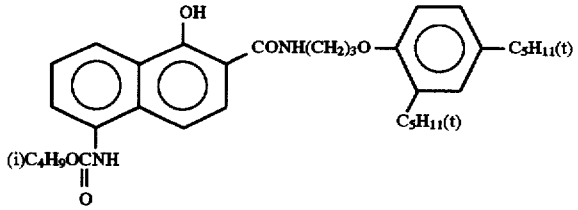
ExC-6
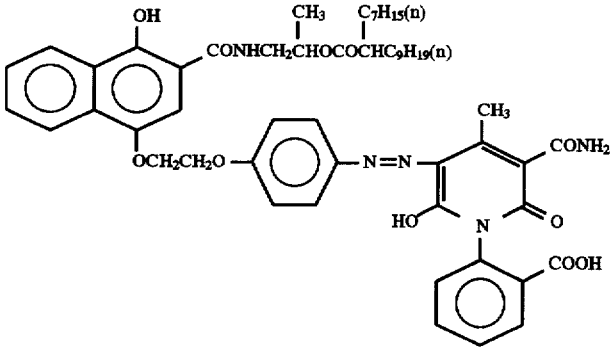

-continued
ExC-7
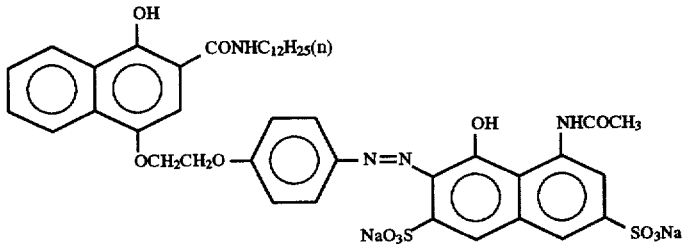
ExC-8
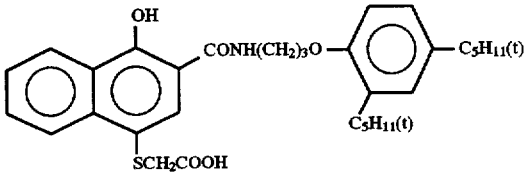
ExC-9
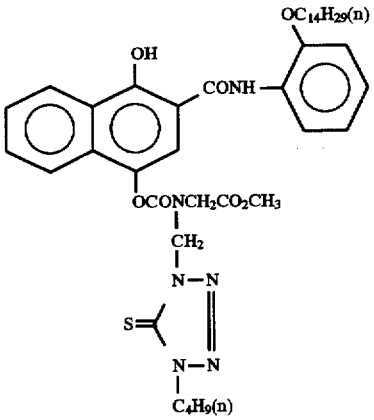
ExC-10
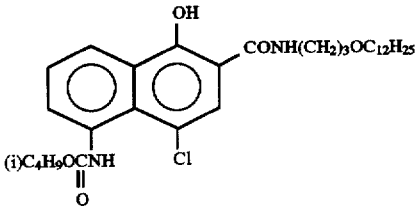
ExM-1
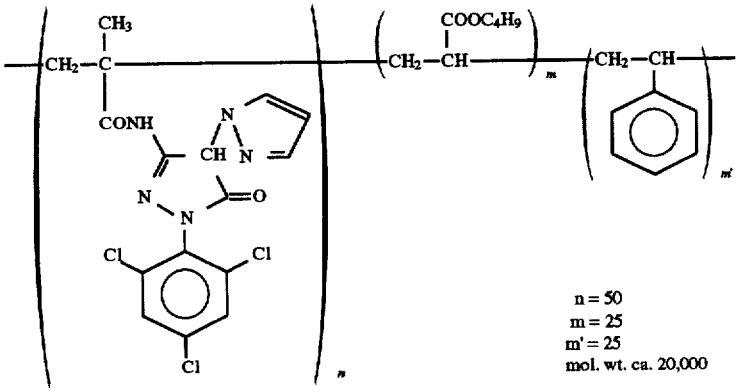

-continued
ExM-2
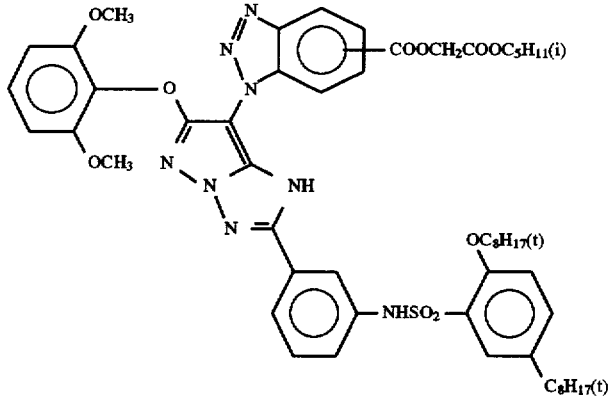
ExM-3
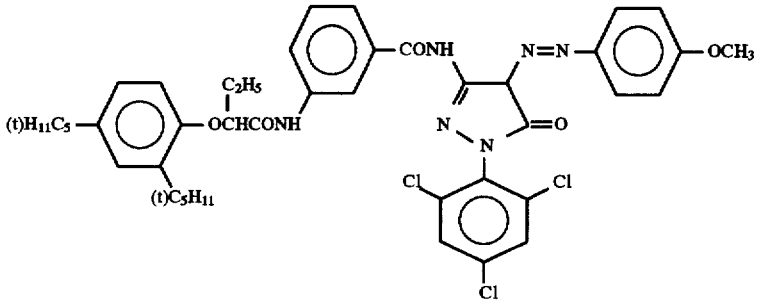
ExM-4
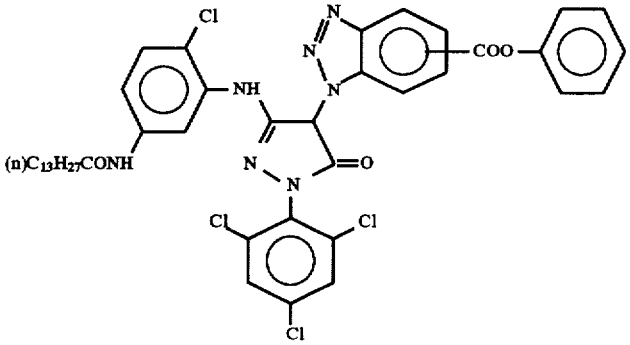
ExM-5
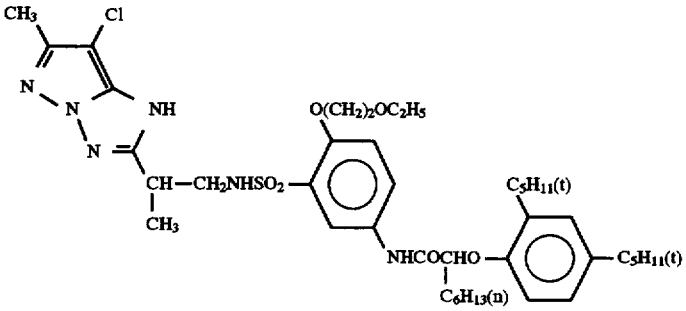

-continued
ExM-6
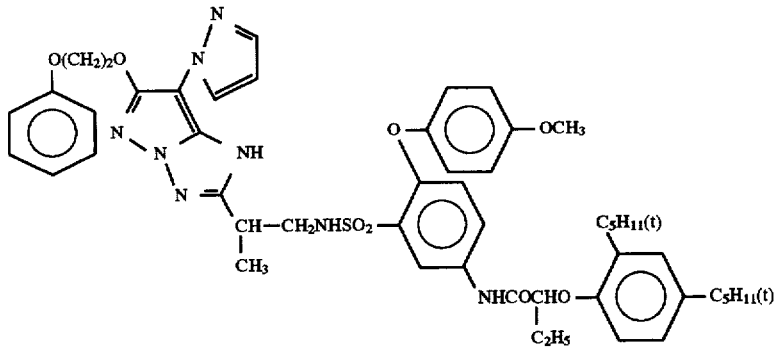
ExM-7
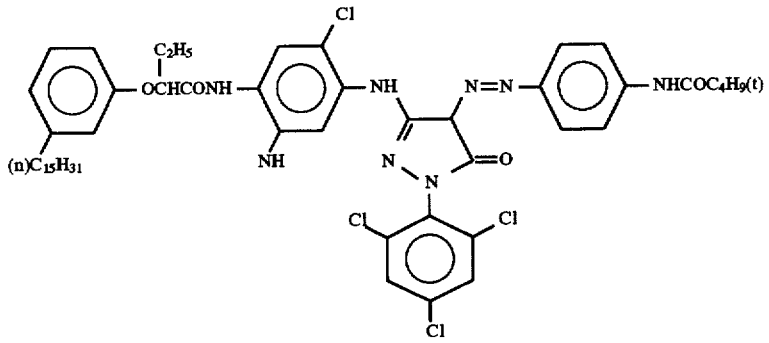
ExM-8
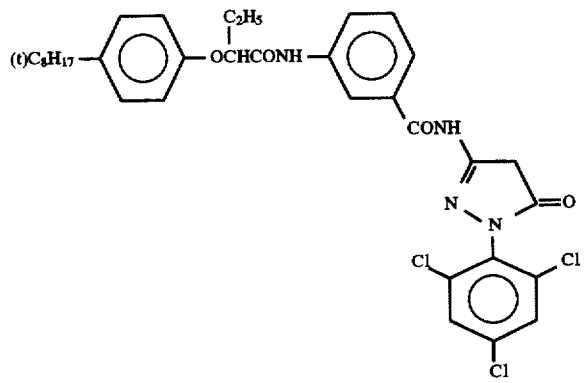
ExM-9
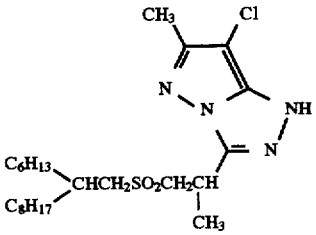
ExY-1
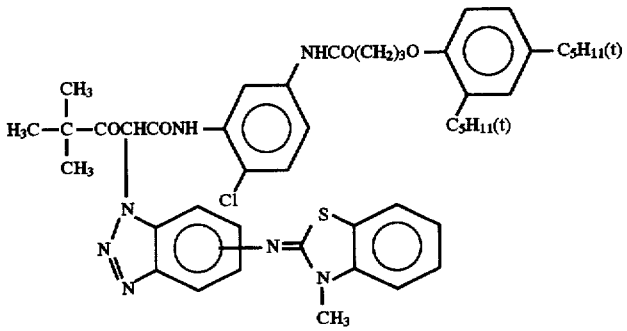

-continued
ExY-2
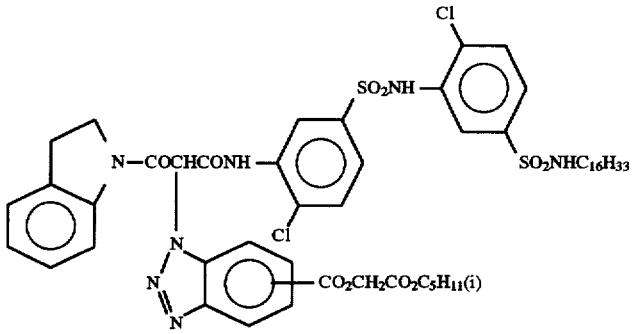
ExY-3
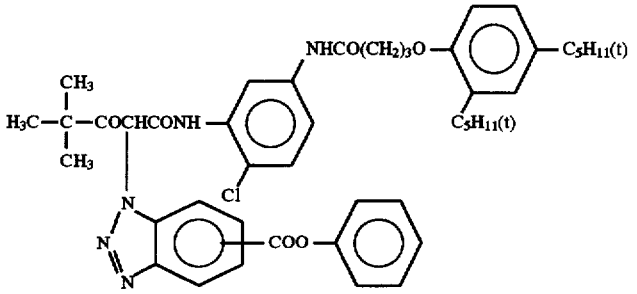
ExY-4
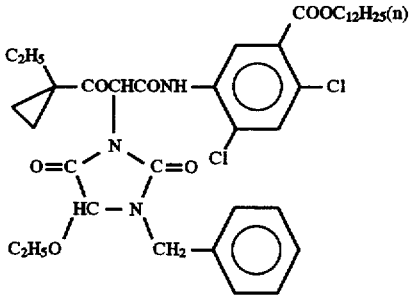
Cpd-1
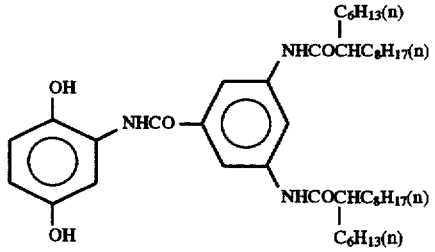
Cpd-2
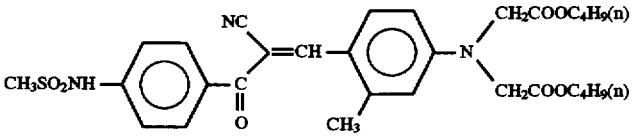
Cpd-3
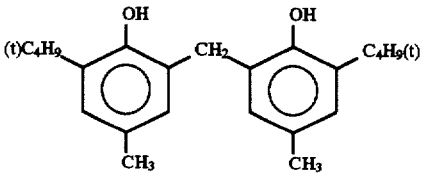

-continued
Cpd-4
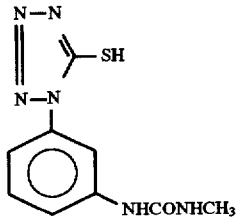
Cpd-5
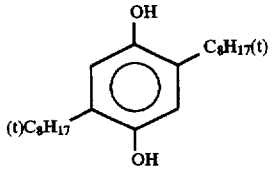
Solv-1
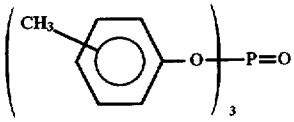
Solv-2
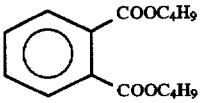
Solv-3
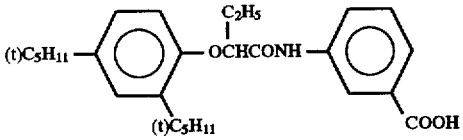
Solv-4
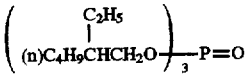
Solv-5
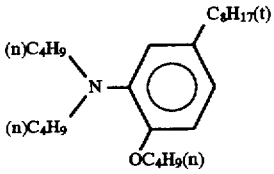
ExS-1
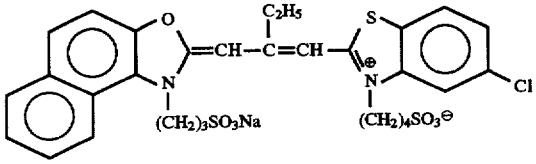
ExS-2
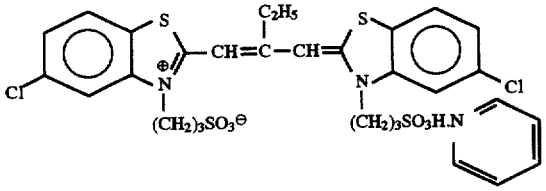
ExS-3
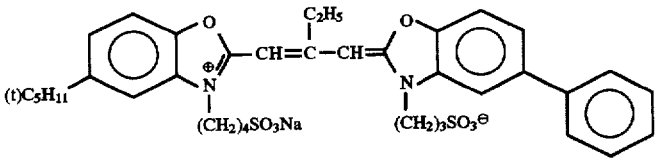

-continued
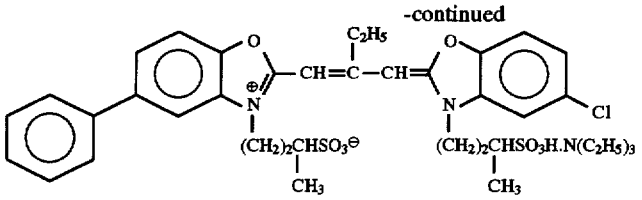
ExS-4
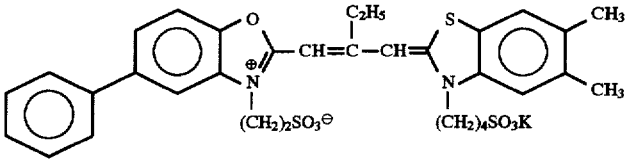
ExS-5
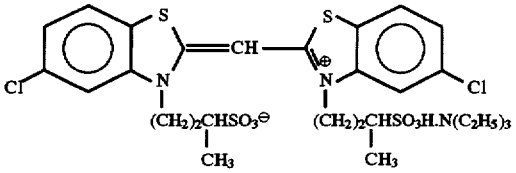
ExS-6
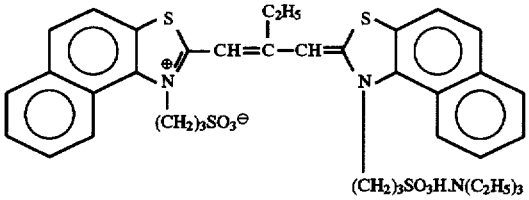
ExS-7
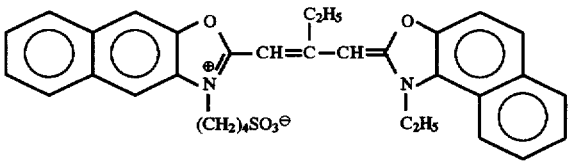
ExS-8
$CH_2{=}CH{-}SO_2{-}CH_2{-}CONH{-}CH_2$
$CH_2{=}CH{-}SO_2{-}CH_2{-}CONH{-}CH_2$
H-1
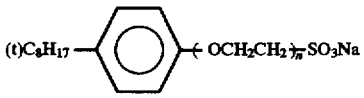
n = 2 ~ 4
W-1
$C_8F_{17}SO_2NHCH_2CH_2CH_2OCH_2CH_2\overset{\oplus}{N}(CH_3)_3$
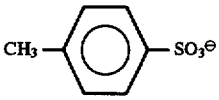
W-2
$(n)C_4H_9CH(C_2H_5)CH_2COOCH_2$
$(n)C_4H_9CH(C_2H_5)CH_2COOCH(SO_3Na)$
W-3
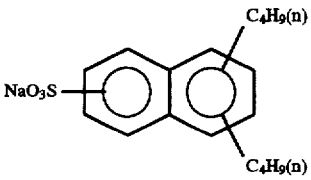
W-4
$C_8F_{17}SO_2N(C_3H_7)CH_2COOK$
W-5

-continued
W-6
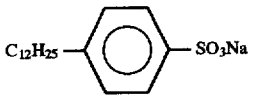
B-1
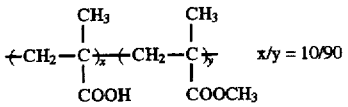
x/y = 10/90
B-2
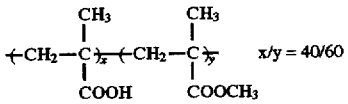
x/y = 40/60
B-3
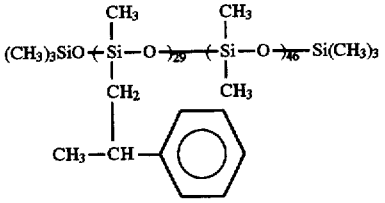
B-4
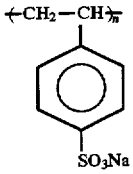
B-5
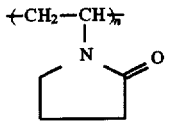
(mol. wt. ca. 10,000)
B-6
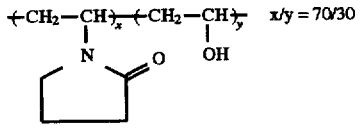
x/y = 70/30
F-1
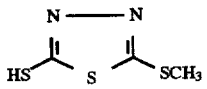
F-2
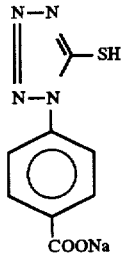
F-3
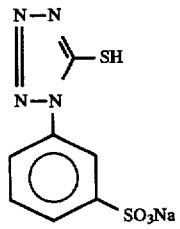

-continued
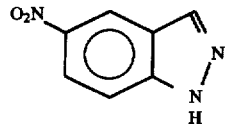
F-4
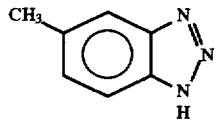
F-5
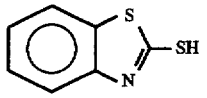
F-6
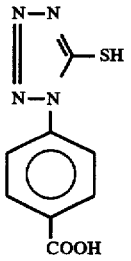
F-7
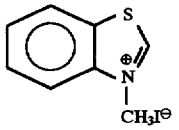
F-8
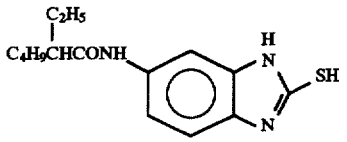
F-9
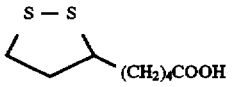
F-10
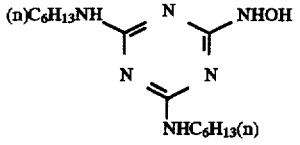
F-11
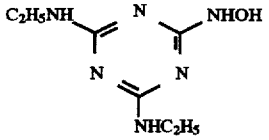
F-12
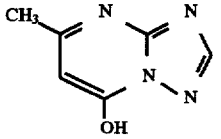
F-13
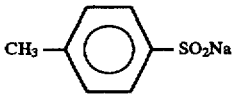
F-14

-continued

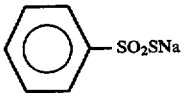

F-15

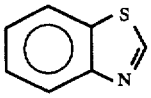

F-16

The processing steps and composition of each processing solution are shown below, provided that each processing was carried out with each processing solution that had been used for processing other samples exposed to light imagewise, continuously (in running) by one $m^2$ per day.

| Processing step | Processing time | Processing temperature | Replenisher* | Tank Volume |
|---|---|---|---|---|
| Color developing | 3 min 5 sec | 38.0° C. | 600 ml | 10 liter |
| Bleaching | 50 sec | 38.0° C. | 140 ml | 5 liter |
| Bleach-fixing | 50 sec | 38.0° C. | — | 5 liter |
| Fixing | 50 sec | 38.0° C. | 420 ml | 5 liter |
| Washing | 30 sec | 38.0° C. | 980 ml | 3.5 liter |
| Stabilizing (1) | 20 sec | 38.0° C. | — | 3 liter |
| Stabilizing (2) | 20 sec | 38.0° C. | 560 ml | 3 liter |
| Drying | 1 min 30 sec | 60° C. | | |

Note: *Replenisher amount per $m^2$ of light-sensitive material.

Stabilizing was carried out in a countercurrent mode from tank (2) to tank (1). Overflow solutions from washing were all introduced into fixing bath. Replenishing to bleach-fixing bath was carried out by flowing all the overflow solutions, caused by supplying replenisher to bleaching tank and fixing tank, into bleach-fixing bath trough cutouts that were provided at the head of bleaching tank and the head of fixing tank of the automatic developer. Further, the carried over amount of developer to the bleaching step, the carried over amount of bleaching solution to the bleach-fixing step, the carried over amount of bleach-fixing solution to the fixing step, and the carried over amount of fixing solution to the washing step, were respectively 65 ml, 50 ml, 50 ml and 50 ml, per $m^2$ of the light-sensitive material. Each crossover time was 6 sec and is included in the processing time of the preceding step.

The composition of each processing solution was as follows, respectively:

| | Tank Solution (g) | Replenisher (g) |
|---|---|---|
| (Color-developer) | | |
| Diethylenetriaminepentaacetic acid | 2.0 | 2.0 |
| 1-Hydroxyethylidene-1,1-diphosphonic acid | 2.0 | 2.0 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)-amino]aniline sulfonate | 4.5 | 6.0 |
| Water to make | 1.0 liter | 1.0 liter |
| pH | 10.05 | 10.15 |
| (pH was adjusted by potassium hydroxide and sulfuric acid) | | |
| (Bleaching solution) | | |
| Iron (III) ammonium 1,3-diaminopropane-tetraacetate monohydrate | 130.0 | 195.0 |
| Ammonium bromide | 70 | 105 |
| Ammonium nitrate | 14 | 21 |
| Hydroxyacetic acid | 50 | 75 |
| Acetic acid | 40 | 60 |
| Water to make | 1.0 liter | 1.0 liter |
| pH | 4.4 | 4.4 |

(pH was adjusted by aqueous ammonia)

Bleach-fixing tank solution)

Mixed solution of the above bleaching tank solution and the following fixing tank solution in a volume ratio of 15:85. (pH 7.0)

| (Fixing solution) | Tank solution (g) | Replenisher (g) |
|---|---|---|
| Ammonium sulfite | 19 | 57 |
| Aqueous ammonium thiosulfate solution (700 g/liter) | 280 ml | 840 ml |
| Imidazole | 15 | 45 |
| Ethylenediaminetetraacetic acid | 15 | 45 |
| Water to make | 1.0 liter | 1.0 liter |
| pH | 7.4 | 7.45 |

(pH was adjusted by aqueous ammonia and acetic acid)

(Washing water)

Tap water was treated by passage through a mixed bed ion-exchange column filled with H-type strong acidic cation exchange resin (Amberlite IR-120B, tradename, made by Rohm & Haas) and OH-type strong basic anion exchange resin (Amberlite IRA-400, the same as the above) so that the concentrations of Ca ions and Mg ions in water were both made to decrease to below 3 mg/liter, followed by adding 20 mg/liter of sodium dichlorinated isocyanurate and 150 mg/liter of sodium sulfate. The pH of this water was in the range of 6.5 to 7.5.

| (Stabilizing solution) (Both tank solution and replenisher) | (g) |
|---|---|
| Sodium p-toluenesulfinate | 0.03 |
| Polyoxyethylene-p-monononylphenylether (av. polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl)pyperazine | 0.75 |
| Water to make | 1.0 liter |
| pH | 8.5 |

With respect to the processed samples, densitometries of B, G, and R were conducted, to obtain a characteristic curve. Measured from the characteristic curve were a minimum density, and a logarithmic value of the reciprocal of an exposure amount necessary to give a density of the minimum density plus 0.2. The absolute value of the difference between the value obtained from a sample stored at 55° C., 30% RH and the value obtained from a sample stored at 5° C., 30% RH (the ΔDmin and the ΔSnega, respectively), was calculated.

TABLE 2

| | Film-production for support | | | | | | | | | | | |
|---|---|---|---|---|---|---|---|---|---|---|---|---|
| | | Shape of pellet | | | Conditions of extruding | | | | | | | |
| | | | Ratio of surface area/ | Heat treatment of | Temperature in extruder | | | Retention | Remaining acetaldehyde | Remaining oligomer | | Thickness of |
| Level | Support Polymer | size mm | volume $mm^{-1}$ | pellets 'C. × hr. | Inlet °C. | Middle °C. | Outlet °C. | time min. | ppm | $mg/m^2$ | Surface Property | film μm |
| 1-1 | PEN | 4 × 4 × 2 | 2.0 | 210 × 3 | 280 | 290 | 300 | 8 | 1.5 | 0.5 | ○ | 90 |
| -2 | " | " | " | " | 295 | 295 | 295 | 8 | 5.5 | 0.5 | ○ | 90 |
| -3 | " | " | " | " | 280 | 280 | 280 | 8 | 1.0 | 0.6 | × | 90 |
| -4 | " | " | " | " | 280 | 290 | 300 | 2.5 | 1.1 | 0.7 | × | 90 |
| -5 | " | " | " | " | " | " | " | 3.5 | 1.2 | 0.7 | Δ | 90 |
| -6 | " | " | " | " | " | " | " | 28 | 4.8 | 0.4 | ○ | 90 |
| -7 | " | " | " | " | " | " | " | 32 | 5.2 | 0.4 | ○ | 90 |
| -8 | " | " | " | " | " | " | " | 8 | 2.8 | 1.7 | ○ | 90 |
| -9 | " | " | " | 250 × 0.4 | " | " | " | " | 1.4 | 1.6 | ○ | 90 |
| -10 | " | " | " | 250 × 0.6 | " | " | " | " | 1.4 | 1.4 | ○ | 90 |
| -11 | " | ∞ | " | 135 × 25' | " | " | " | " | 5.2 | 0.3 | ○ | 90 |
| -12 | " | " | " | 135 × 22 | " | " | " | " | 4.9 | 0.3 | ○ | 90 |
| -13 | " | 15 × 15 × 8 | 0.52 | 210 × 3 | " | " | " | " | 1.7 | 1.4 | ○ | 90 |
| -14 | " | 15 × 15 × 9 | 0.48 | " | " | " | " | " | 1.7 | 1.6 | ○ | 90 |
| -15 | P-2* | 4 × 4 × 2 | 2.0 | 200 × 3 | 280 | 290 | 300 | " | 1.4 | 0.6 | ○ | 90 |
| -16 | P-6* | " | " | 215 × 3 | 290 | 300 | 310 | " | 1.2 | 0.4 | ○ | 90 |
| -17 | P-13* | " | " | 195 × 3 | 280 | 290 | 300 | " | 1.3 | 0.6 | ○ | 90 |
| -18 | P-14* | " | " | 220 × 3 | 290 | 300 | 310 | " | 1.2 | 0.4 | ○ | 90 |

*) These correspond to the specific examples of co-polymers or polymer-blends, described in this specification.

| | | | | | | | | | | | | | |
|---|---|---|---|---|---|---|---|---|---|---|---|---|---|
| | BTA treatment | | Photographic properties | | | | Adhesive properties | | Core set curl after development | Numver of clacks after development | Uneveness generated after development | Transverse curl (curl in width direction) | |
| | | | Dmin | | Snega | | | | | | | | |
| Level | °C. × hr. | Emulsion*) | G | R | G | R | Dry | Wet | $m^{-1}$ | times | | Transverse curl $m^{-1}$ | Scratches generated in camera |
| 1-1 | 110 × 24 | nega | 0.05 | 0.02 | 0.07 | 0.05 | ○ | ○ | 60 | 0 | OK | 40 | ○ |
| -2 | 110 × 24 | " | 0.10 | 0.06 | 0.16 | 0.13 | ○ | ○ | 61 | 0 | OK | 38 | ○ |
| -3 | *1 | *1 | *1 | *1 | *1 | *1 | *1 | *1 | 64 | 0 | OK | *1 | *1 |
| -4 | *1 | *1 | *1 | *1 | *1 | *1 | *1 | *1 | 64 | 0 | OK | *1 | *1 |
| -5 | 110 × 24 | nega | 0.06 | 0.03 | 0.08 | 0.06 | ○ | ○ | 63 | 0 | OK | 39 | ○ |
| -6 | " | " | 0.08 | 0.05 | 0.13 | 0.11 | ○ | ○ | 62 | 0 | OK | 41 | ○ |
| -7 | " | " | 0.10 | 0.06 | 0.15 | 0.13 | ○ | ○ | 64 | 0 | OK | 40 | ○ |
| -8 | " | " | 0.07 | 0.04 | 0.10 | 0.08 | Δ | Δ | 60 | 0 | OK | 38 | ○ |
| -9 | " | " | 0.05 | 0.02 | 0.06 | 0.05 | Δ | Δ | 59 | 0 | OK | 41 | ○ |
| -10 | " | " | 0.05 | 0.02 | 0.06 | 0.05 | ○ | ○ | 58 | 0 | OK | 39 | ○ |
| -11 | " | " | 0.10 | 0.06 | 0.16 | 0.13 | ○ | ○ | 60 | 0 | OK | 41 | ○ |
| -12 | " | " | 0.08 | 0.05 | 0.13 | 0.11 | ○ | ○ | 59 | 0 | OK | 38 | ○ |
| -13 | " | " | 0.05 | 0.02 | 0.07 | 0.05 | ○ | ○ | 61 | 0 | OK | 39 | ○ |
| -14 | " | " | 0.05 | 0.02 | 0.07 | 0.05 | Δ | Δ | 60 | 0 | OK | 41 | ○ |
| -15 | 100 × 24 | " | 0.04 | 0.02 | 0.06 | 0.04 | ○ | ○ | 63 | 0 | OK | 45 | ○ |
| -16 | 145 × 24 | " | 0.04 | 0.02 | 0.06 | 0.04 | ○ | ○ | 62 | 0 | OK | 47 | ○ |
| -17 | 95 × 24 | " | 0.04 | 0.02 | 0.06 | 0.04 | ○ | ○ | 62 | 0 | OK | 46 | ○ |
| -18 | 118 × 24 | " | 0.04 | 0.02 | 0.06 | 0.04 | ○ | ○ | 60 | 0 | OK | 48 | ○ |

Note: *)Emulsions marked with "+" contain a compound of the present invention represented by formula A.
*1) Surface property of support was too bad to evaluate these.

Results

When the present invention was performed with respect to a PEN support, the Levels 1-1, -5, and, -6, each having a low content of acetaldehyde, exhibited excellent photographic characteristics.

The Levels 1-8, -10, -12, and -13, each having a low content of oligomer, exhibited excellent adhesion.

The above-described effects of the present invention were also attained with copolymers and polymer blends, as indicated by the Levels 1-15 to -18, as well as PEN.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method of manufacturing a photographic polyester film comprising subjecting polyester pellets, whose ratio of surface area ($mm^2$) to volume ($mm^3$) is not less than 0.5, to heat treatment at a temperature in the range of from the Tg+10° C. to the Tm−20° C. and forming an unstretched film controlling; each of the temperature of the inlet of a melt extruder, in the range of from the melting point of the polyester (Tm)−10° C. to the Tm+15° C.; the temperature of the central part of a screw, in the range of from the Tm to the Tm+30° C.; and the temperature of the outlet thereof, in the range of from the Tm+10° C. to the Tm+35° C., followed by biaxially stretching and heat-setting, wherein the polyester is (i) a blend of polyethylene naphthalate and polyethylene terephthalate, or (ii) a polyester produced by polymerizing monomers consisting essentially of terephthalic acid, 2,6-naphthalene dicarboxylic acid and of ethylene glycol, wherein a molar ratio of terephthalic acid to 2,6-naphthalene dicarboxylic acid is in the range of from about 0.5:0.5 to about 0:1.0.

2. The method of manufacturing a photographic polyester film as claimed in claim 1, wherein said polyester is polyethylene 2,6-naphthalate.

3. The method of manufacturing a photographic polyester film as claimed in claim 1, wherein the polyester polymer, extruded and molten in the melt extruder, is passed through a filter before the polymer is formed into the unstretched film.

4. The method of manufacturing a photographic biaxially stretched polyester film as claimed in claim 1, wherein the heat treatment is carried out in vacuo or in a current of an inactive gas.

5. The method according to claim 1, wherein said heat treatment is for a period of time ranging from about 30 minutes to about 24 hours.

* * * * *